US009606502B2

(12) United States Patent
Mori et al.

(10) Patent No.: US 9,606,502 B2
(45) Date of Patent: Mar. 28, 2017

(54) CARTRIDGE AND IMAGE FORMING DEVICE

(71) Applicant: Brother Kogyo Kabushiki Kaisha, Nagoya-shi, Aichi-ken (JP)

(72) Inventors: Hiroki Mori, Nagoya (JP); Tatsuo Ogasawara, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/593,180

(22) Filed: Jan. 9, 2015

(65) Prior Publication Data

US 2015/0117873 A1 Apr. 30, 2015

Related U.S. Application Data

(63) Continuation-in-part of application No. PCT/JP2012/080825, filed on Nov. 29, 2012.

(30) Foreign Application Priority Data

Jul. 9, 2012 (JP) ..... 2012-154133

(51) Int. Cl.
*G03G 15/08* (2006.01)
*G03G 21/16* (2006.01)
*G03G 21/18* (2006.01)

(52) U.S. Cl.
CPC ..... *G03G 21/1647* (2013.01); *G03G 21/1857* (2013.01); *G03G 2221/1657* (2013.01)

(58) Field of Classification Search
CPC ..... G03G 15/0832; G03G 2221/1823; G03G 21/1647; G03G 21/1857; G03G 2221/1657
(Continued)

(56) References Cited

U.S. PATENT DOCUMENTS 6,173,145 B1 1/2001 Chadani et al.
7,574,148 B2 8/2009 Igarashi et al.
(Continued)

FOREIGN PATENT DOCUMENTS

EP 1505459 A1 2/2005
EP 1965274 A2 9/2008
(Continued)

OTHER PUBLICATIONS

Jun. 23, 2015—(US) Notice of Allowance—U.S. Appl. No. 14/593,131.
(Continued)

*Primary Examiner* — Hoang Ngo
(74) *Attorney, Agent, or Firm* — Banner & Witcoff, Ltd.

(57) ABSTRACT

A cartridge for accommodating developer includes a detected member configured to be detected by an external first sensor, and a drive-force transmission member configured to transmit a drive force to the detected member upon receipt of the drive force from outside. The detected member is configured to rotate in a first direction about a first rotational axis extending in an axial direction. The detected member includes: a receiving part configured to contact the drive-force transmission member to receive the drive force therefrom; and a first detected part. A portion of the first detected part and a portion of the receiving part are arranged at the same position as each other in the axial direction.

9 Claims, 24 Drawing Sheets

(58) Field of Classification Search
USPC ..... 399/12, 111, 120, 167
See application file for complete search history.

(56) References Cited

U.S. PATENT DOCUMENTS

| | | | | |
|---|---|---|---|---|
| 7,853,158 | B2 | 12/2010 | Mikuni | |
| 7,941,072 | B2 | 5/2011 | Ishikawa et al. | |
| 7,991,322 | B2 | 8/2011 | Ukai | |
| 8,417,130 | B2 | 4/2013 | Hashimoto | |
| 8,620,180 | B2 | 12/2013 | Shiraki et al. | |
| 8,712,286 | B2 | 4/2014 | Takagi | |
| 2007/0031158 | A1* | 2/2007 | Kamimura | 399/12 |
| 2007/0122165 | A1 | 5/2007 | Igarashi et al. | |
| 2008/0205911 | A1 | 8/2008 | Ishikawa et al. | |
| 2008/0223173 | A1 | 9/2008 | Ishikawa | |
| 2009/0000423 | A1 | 1/2009 | Ishikawa et al. | |
| 2009/0269086 | A1 | 10/2009 | Mikuni | |
| 2011/0236065 | A1 | 9/2011 | Takagi | |
| 2012/0051795 | A1 | 3/2012 | Mushika et al. | |
| 2015/0117906 | A1 | 4/2015 | Mori | |

FOREIGN PATENT DOCUMENTS

| | | | |
|---|---|---|---|
| EP | 2369423 | A1 | 9/2011 |
| JP | H03-279965 | A | 12/1991 |
| JP | H08-248861 | A | 9/1996 |
| JP | H09-258634 | A | 10/1997 |
| JP | H09300993 | A | 11/1997 |
| JP | 2000112240 | A | 4/2000 |
| JP | 2003107976 | A | 4/2003 |
| JP | 2007-148285 | A | 6/2007 |
| JP | 2008-216394 | A | 9/2008 |
| JP | 2009-014789 | A | 1/2009 |
| JP | 2009-244564 | A | 10/2009 |
| JP | 2009-265401 | A | 11/2009 |
| JP | 2010-128115 | A | 6/2010 |
| JP | 2011-013323 | A | 1/2011 |
| JP | 3167020 | U | 3/2011 |
| JP | 2011-203366 | A | 10/2011 |
| JP | 2012-013763 | A | 1/2012 |
| JP | 2012-053095 | A | 3/2012 |
| WO | 2006/079158 | A1 | 8/2006 |

OTHER PUBLICATIONS

Jan. 22, 2015—(WO) International Preliminary Report on Patentability—App PCT/JP2012/080832, Eng Tran.
Jan. 22, 2015—(WO) International Preliminary Report on Patentability—App PCT/JP2012/080825, Eng Tran.
Mar. 1, 2016—(JP) Office Action—App 2012-154141, Eng Tran.
Feb. 5, 2016—(US) Notice of Allowance—U.S. Appl. No. 14/858,288.
Feb. 3, 2016—(EP) Extended Search Report—App 12880919.1.
Feb. 3, 2016—(EP) Extended Search Report—App 12880810.2.
Nov. 24, 2015—(JP) Office Action—App 2012-154133, Eng Tran.
Jul. 11, 2016—(US) Non-Final Office Action—U.S. Appl. No. 14/858,288.
Sep. 13, 2016—(US) Non-Final Office Action (LTR Restarting Period for Resp.)—U.S. Appl. No. 14/858,288.

* cited by examiner

CARTRIDGE AND IMAGE FORMING DEVICE

CROSS REFERENCE TO RELATED APPLICATION

This application claims priority from Japanese Patent Application No. 2012-154133 filed Jul. 9, 2012. This application is also a continuation-in-part of International Application No. PCT/JP2012/080825 filed Nov. 29, 2012 in Japan Patent Office as a Receiving Office. The entire contents of both applications are incorporated herein by reference.

TECHNICAL FIELD

The present invention relates to a cartridge that is mounted in an image forming device employing an electrophotographic system and to the image forming device in which this cartridge is mounted.

BACKGROUND

As a conventional image forming device that employs an electrophotographic system, there is known a printer provided with a photosensitive member, and a developer cartridge that supplies toner to the photosensitive member.

This type of printer is also provided with sensing means for detecting information on the mounted developing cartridge (whether the developing cartridge is a new product, for example).

According to one method that has been proposed for determining information about a developing cartridge, a rotary body is rotatably provided in the developing cartridge and has a contact protrusion that contacts a sensing arm in a main casing of an image forming device. When the developing cartridge is mounted in the main casing, the rotary body is driven to rotate by a prescribed drive force. The contact protrusion on the rotary body contacts and pivots the sensing arm, and a photosensor detects the pivoting motion of the sensing arm. Information about the developing cartridge is determined based on the results of this detection (see Japanese Patent Application Publication no. 2009-244564, for example).

SUMMARY

However, the rotary body provided in the new-product specification sensing device described above is engaged with a transmission gear through a gear-tooth portion provided at an inner part of the rotary body in the left-right direction, while the contact protrusion extends outward in the left-right direction away from the gear-tooth portion.

This structure requires the rotary body to have a larger left-right dimension, which is an obstacle to producing a compact developing cartridge.

In view of the foregoing, it is an object of the present invention to provide a cartridge that can be made more compact, and an image forming device in which this cartridge is mounted.

In order to attain the above and other objects, there is provided a cartridge configured to accommodate developer that may include a detected member and a drive-force transmission member. The detected member is configured to be detected by an external first sensor and is configured to rotate in a first direction about a first rotational axis extending in an axial direction. The drive-force transmission member is configured to transmit a drive force to the detected member upon receipt of the drive force from outside. The detected member includes: a receiving part configured to contact the drive-force transmission member to receive the drive force therefrom; and a first detected part, a portion of the first detected part and a portion of the receiving part being arranged at the same position as each other in the axial direction.

According to another aspect of the present invention, there is provided an image forming device that may include a main body, a photosensitive-drum cartridge detachable from and attachable to the main body, and a cartridge mountable on and removable from the photosensitive-drum cartridge. The main body is provided with a first sensor and a second sensor. The photosensitive-drum cartridge is provided with a photosensitive member for carrying an electrostatic latent image thereon, the second sensor being configured to detect whether the photosensitive-drum cartridge is attached to the main body. The cartridge is configured to accommodate developer therein and includes a detected member and a drive-force transmission member. The detected member is configured to rotate in a first direction about a first rotational axis extending in an axial direction, the detected member being configured to be detected by the first sensor, the detected member including a receiving part and a first detected part. The drive-force transmission member is configured to transmit a drive force to the detected member upon receipt of the drive force from the main body, the receiving part being configured to contact the drive-force transmission member to receive the drive force therefrom, a portion of the first detected part and a portion of the receiving part being arranged at the same position as each other in the axial direction, the main body being configured to input the drive force to the cartridge after the second sensor detects whether the photosensitive-drum cartridge is attached to the main body.

DETAILED DESCRIPTION

1. Printer

Figure 1:
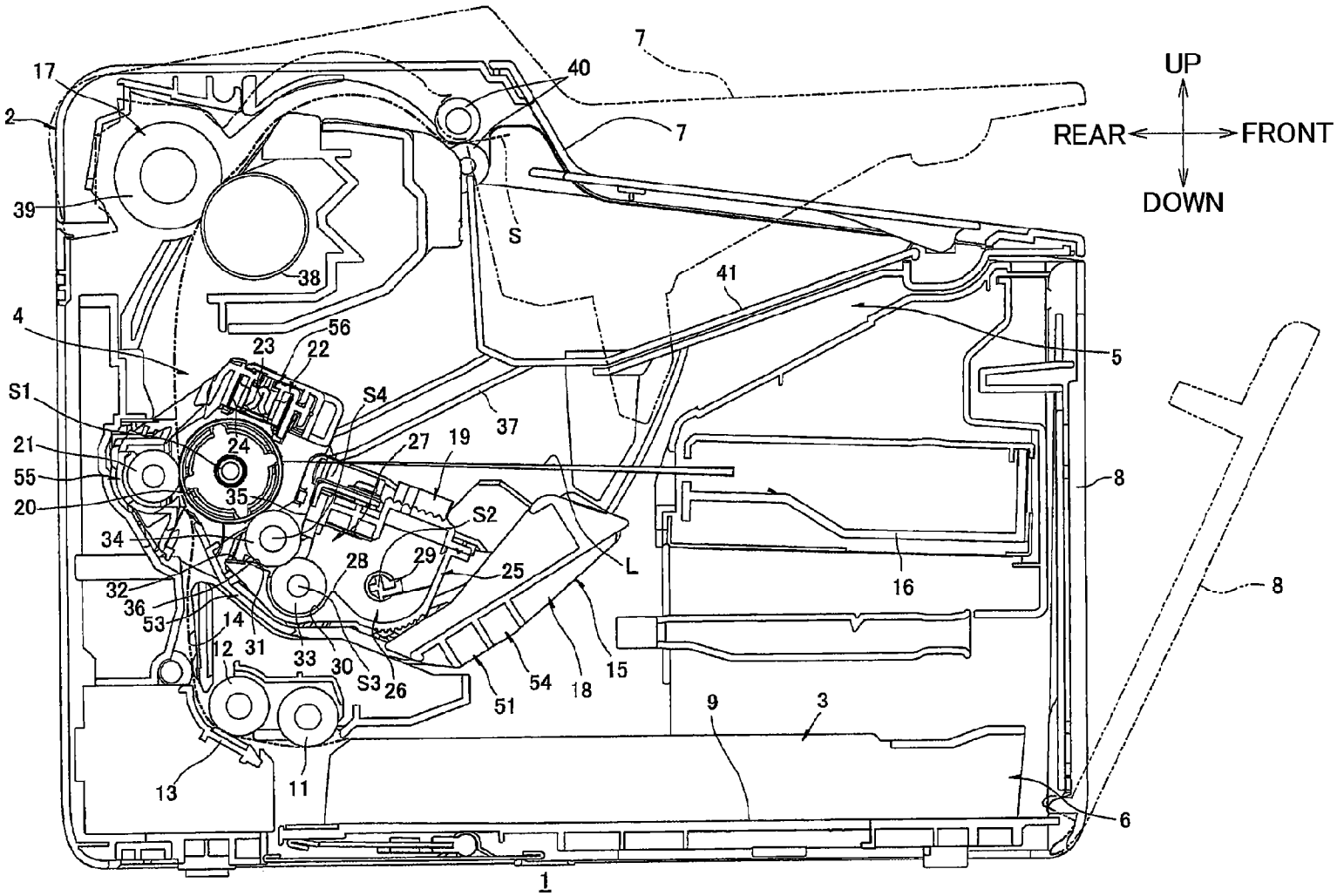
FIG. 1 is a central cross-sectional view of a printer as an image forming device according to a first embodiment of the present invention.

FIG. 1 shows a printer 1 serving as an example of an image forming device according to a first embodiment of the present invention. The printer 1 has a developing cartridge 19 according to the first embodiment of the invention mounted therein. The printer 1 is provided with a main casing 2 as an example of a box-like shaped main body for the printer 1.

Within the main casing 2, the printer 1 is also provided with a sheet-feeding unit 3 for feeding sheets S of paper, and an image-forming unit 4 for forming images on the sheets S supplied by the sheet-feeding unit 3.

Directions related to the printer 1 and to a process cartridge 15 (described later) will be specified based on orientations of these devices when resting on a level surface, and specifically will refer to the directions indicated by arrows in the drawings.

(1) Main Casing

Formed in the main casing 2 are a cartridge access opening 5 for mounting and removing the process cartridge 15 (described later), and a paper-introducing opening 6 through which the sheets S of paper are inserted into the main casing 2.

The cartridge access opening 5 is formed in an upper end portion of the main casing 2, penetrating the main casing 2 vertically.

The paper-introducing opening 6 is formed in a bottom portion on a front end portion of the main casing 2 and penetrates the front end portion in a front-rear direction.

The main casing 2 also includes a top cover 7 disposed on the upper end portion thereof, and a sheet-feeding cover 8 disposed on the front end portion thereof.

The top cover 7 is disposed so as to be capable of pivoting (moving) about its rear edge portion between a closed position for covering the cartridge access opening 5, and an open position for exposing the cartridge access opening 5 (see phantom lines in FIG. 1).

The sheet-feeding cover 8 is disposed so as to be capable of pivoting (moving) about its bottom edge portion between a first position for covering the paper-introducing opening 6, and a second position for exposing the paper-introducing opening 6.

(2) Sheet-Feeding Unit

The sheet-feeding unit 3 includes a sheet-supporting part 9 provided in a lower portion of the main casing 2.

The sheet-supporting part 9 is in communication with the exterior of the main casing 2 through the paper-introducing opening 6.

The sheets S of paper are placed in the sheet-feeding unit 3 when the sheet-feeding cover 8 is in its second position for exposing the paper-introducing opening 6. More specifically, the sheets S are inserted through the paper-introducing opening 6 such that rear portions of the sheets S are stacked in the sheet-supporting part 9 and front portions of the sheets S are stacked on a top surface of the sheet-feeding cover 8.

The sheet-feeding unit 3 further includes a pickup roller 11 disposed above a rear edge portion of the sheet-supporting part 9, a feeding roller 12 disposed rearward of the pickup roller 11, a feeding pad 13 arranged to confront the lower rear side of the feeding roller 12, and a feeding path 14 extending continuously upward from a rear edge of the feeding pad 13.

(3) Image-Forming Unit

The image-forming unit 4 includes the process cartridge 15, a scanning unit 16, and a fixing unit 17.

(3-1) Process Cartridge

The process cartridge 15 can be mounted in and removed from the main casing 2. When mounted in the main casing 2, the process cartridge 15 is arranged above a rear portion of the sheet-feeding unit 3.

The process cartridge 15 includes a drum cartridge 18 and the developing cartridge 19. The drum cartridge 18 is an example of a photosensitive-member cartridge that is detachably mountable in the main casing 2. The developing cartridge 19 is an example of a cartridge that is detachably mountable on the drum cartridge 18.

The drum cartridge 18 includes a photosensitive drum 20 as an example of a photosensitive member, a transfer roller 21, and a scorotron charger 22.

The photosensitive drum 20 is formed in a general columnar shape that is elongated in a left-right direction. The photosensitive drum 20 is provided in a rear portion of the drum cartridge 18. The photosensitive drum 20 is provided with a rotational shaft (hereinafter called as a "drum shaft S1") whose central axis is oriented in the left-right direction, and is capable of rotating about the central axis of the drum shaft S1.

The transfer roller 21 is formed in a general columnar shape that is elongated in the left-right direction. The transfer roller 21 is provided in the rear portion of the drum cartridge 18 so as to contact the rear side of the photosensitive drum 20 with pressure.

More specifically, the transfer roller 21 is disposed on the rear side of the photosensitive drum 20 such that a central axis of the transfer roller 21 is positioned slightly lower than the central axis of the photosensitive drum 20. Note that the transfer roller 21 has a lower peripheral surface higher than a lower peripheral surface of the photosensitive drum 20. That is, a virtual line segment (not shown) connecting the central axis of the transfer roller 21 to the central axis of the photosensitive drum 20 forms an acute angle of approximately 3° with a virtual line (not shown) extending horizontally in the front-rear direction. Accordingly, the weight of the transfer roller 21 does not affect the pressure with which the transfer roller 21 contacts the photosensitive drum 20 (transfer pressure).

The scorotron charger 22 is arranged to confront the upper front side of the photosensitive drum 20 with a gap formed therebetween.

More specifically, the scorotron charger 22 is disposed in a position separated from the transfer roller 21 in a circumferential direction of the photosensitive drum 20. The scorotron charger 22 is disposed such that the virtual line segment (not shown) connecting the central axis of the photosensitive drum 20 with the central axis of the transfer roller 21 forms an angle of approximately 120° with a virtual line segment (not shown) connecting the central axis of the photosensitive drum 20 with a charging wire 23 (described later).

The scorotron charger 22 further includes the charging wire 23 and a grid 24.

The charging wire 23 is arranged in a taut state to extend in the left-right direction and is disposed so as to confront but remain separated from the upper front side of the photosensitive drum 20.

The grid 24 is formed to have a general U-shape in a side view with the opening of the "U" facing diagonally upward and forward so as to surround the charging wire 23 from a lower rear side thereof.

The developing cartridge 19 is disposed on the lower front side of the photosensitive drum 20. The developing cartridge 19 includes a developing-cartridge frame 25 as an example of a casing.

A toner-accommodating chamber 26 and a development chamber 27 are formed in the developing-cartridge frame 25. The toner-accommodating chamber 26 and development chamber 27 are provided side by side in the front-rear direction, with a communication opening 28 allowing communication between the two. The toner-accommodating chamber 26 and development chamber 27 have substantially the same capacity as each other.

The toner-accommodating chamber 26 accommodates toner (developer). An agitator 29 is provided in an approximate front-rear and vertical center region of the toner-accommodating chamber 26. In other words, the agitator 29 is positioned lower than the photosensitive drum 20.

The agitator 29 includes a rotational shaft (hereinafter called as an "agitator shaft S2") oriented in the left-right direction and is capable of rotating about a central axis of the agitator shaft S2.

In the development chamber 27 are formed a supply-roller groove 30, a developing-roller-opposing surface 31, and a lower-film-adhering surface 32 as part of a top surface of a bottom wall 72 (described later).

The supply-roller groove 30 is formed in a general semicircular shape conforming to a circumferential surface of a supply roller 33 (described later), with the convex shape of the supply-roller groove 30 facing obliquely downward and rearward.

The developing-roller-opposing surface 31 is formed in a general arc shape that conforms to a circumferential surface of a developing roller 34 (described later). The developing-roller-opposing surface 31 extends continuously from a rear edge of the supply-roller groove 30 toward upward and rearward.

The lower-film-adhering surface 32 is formed continuously with a rear edge of the developing-roller-opposing surface 31 and extends rearward therefrom. That is, the lower-film-adhering surface 32 is arranged higher than the developing-roller-opposing surface 31.

The lower-film-adhering surface 32 is also arranged to confront the bottom portion of the photosensitive drum 20 vertically, with a gap formed therebetween. The lower-film-adhering surface 32 is arranged to overlap the central axis of the photosensitive drum 20 when projected vertically.

The supply roller 33, the developing roller 34, a thickness-regulating blade 35, and a lower film 36 are provided in the development chamber 27.

The supply roller 33 is formed in a general columnar shape that is elongated in the left-right direction. The supply roller 33 is provided in a front region of the development chamber 27 with its bottom portion disposed in the supply-roller groove 30. The supply roller 33 includes a rotational shaft (hereinafter called as a "supply roller shaft S3") oriented in the left-right direction along a central axis of the supply roller 33 and is capable of rotating about the central axis of the supply roller shaft S3. With this configuration, the supply roller 33 is disposed to the rear side of the toner-accommodating chamber 26 and is arranged at the same approximate height as the toner-accommodating chamber 26 (slightly higher than the toner-accommodating chamber 26).

The developing roller 34 is formed in a general columnar shape that is elongated in the left-right direction. The developing roller 34 is provided in a rear region of the development chamber 27 such that its bottom circumferential surface opposes the developing-roller-opposing surface 31 yet remains separated therefrom. The developing roller 34 is provided with a rotational shaft (hereinafter called as a "developing roller shaft S4") oriented in the left-right direction along a central axis of the developing roller 34 and is capable of rotating about the central axis of the developing roller shaft S4.

The developing roller 34 is also disposed to contact the upper rear side of the supply roller 33 and so that its upper and rear portions are exposed outside the development chamber 27 and contact the lower front side of the photosensitive drum 20. In other words, the developing roller 34 is arranged on the upper rear side of the supply roller 33 and the lower front side of the photosensitive drum 20. The central axes of the supply roller 33, developing roller 34, and photosensitive drum 20 are positioned on substantially the same line following a radial direction of the photosensitive drum 20.

The developing roller 34 is also disposed in a position separated from the scorotron charger 22 in the circumferential direction of the photosensitive drum 20 and is arranged such that a virtual line segment (not shown) connecting the central axis of the photosensitive drum 20 to the charging wire 23 forms an angle of approximately 120° with a virtual line segment (not shown) connecting the central axis of the photosensitive drum 20 to the central axis of the developing roller 34. Hence, the developing roller 34, scorotron charger 22, and transfer roller 21 are arranged at substantially equal intervals in the circumferential direction of the photosensitive drum 20.

The thickness-regulating blade 35 has an upper end fixed to a rear end of a top wall defining the development chamber 27. The thickness-regulating blade 35 has a bottom end that contacts the developing roller 34 from the front side thereof.

The lower film 36 has a rear portion fixed to the lower-film-adhering surface 32. A front edge of the lower film 36 contacts the circumferential surface of the developing roller 34 above the developing-roller-opposing surface 31.

(3-2) Scanning Unit

The scanning unit 16 is arranged frontward of the process cartridge 15 to oppose but be separated from the photosensitive drum 20 in the front-rear direction.

The scanning unit 16 irradiates a laser beam L toward the photosensitive drum 20 based on image data, thereby exposing the circumferential surface of the photosensitive drum 20.

More specifically, the scanning unit 16 irradiates the laser beam L rearward to expose the circumferential surface of the photosensitive drum 20 on the front side thereof. In other words, the exposure point at which the photosensitive drum 20 is exposed to light (the circumferential surface on the front side of the photosensitive drum 20) is configured to be on a side opposite to a nip part at which the photosensitive drum 20 and transfer roller 21 contact each other with respect to the central axis of the photosensitive drum 20.

At this time, the developing cartridge 19 is arranged beneath an irradiation path of the laser beam L, while the scorotron charger 22 is disposed above the irradiation path of the laser beam L.

Guide parts 37 are provided on inner surfaces of the main casing 2 opposing the space between the scanning unit 16 and photosensitive drum 20 for guiding mounting and removal of the process cartridge 15. When removing the process cartridge 15 from the main casing 2, the guide parts 37 guide the process cartridge 15 so that the developing cartridge 19 mounted in the drum cartridge 18 moves upward, passing through the irradiation path of the laser beam L.

At this time, the various rollers provided in the process cartridge 15 (the transfer roller 21, supply roller 33, and developing roller 34) also pass upward through the irradiation path of the laser beam L.

(3-3) Fixing Unit

The fixing unit 17 is disposed above the rear portion of the drum cartridge 18. More specifically, the fixing unit 17 includes a heating roller 38 disposed above the scorotron charger 22, and a pressure roller 39 that contacts the heating roller 38 on an upper rear side thereof with pressure.

Hence, the heating roller 38 is disposed near an upper edge (open side edge) of the grid 24 in the scorotron charger 22.

(4) Image-Forming Operation

The agitator 29 rotates to supply toner from the toner-accommodating chamber 26 of the developing cartridge 19 to the supply roller 33 through the communication opening 28. The supply roller 33 in turn supplies the toner onto the developing roller 34, at which time the toner is positively tribocharged between the supply roller 33 and developing roller 34.

The thickness-regulating blade 35 regulates the thickness of toner supplied to the developing roller 34 as the developing roller 34 rotates so that a thin layer of toner of uniform thickness is carried on the surface of the developing roller 34.

In the meantime, the scorotron charger 22 uniformly charges the surface of the photosensitive drum 20. The scanning unit 16 subsequently exposes the surface of the photosensitive drum 20, forming an electrostatic latent image on the circumferential surface of the photosensitive drum 20 based on image data. Next, the toner carried on the developing roller 34 is supplied to the latent image on the circumferential surface of the photosensitive drum 20 so that a toner image (developer image) is carried on the circumferential surface of the photosensitive drum 20.

The rotating pickup roller 11 supplies the sheets S stacked on the sheet-supporting part 9 between the feeding roller 12 and feeding pad 13, and the rotating feeding roller 12 separates the sheets S, conveys each separated sheet S onto the feeding path 14, and supplies the sheets S one at a time to the image-forming unit 4 (between the photosensitive drum 20 and transfer roller 21) at a prescribed timing.

The sheet S is conveyed upward between the photosensitive drum 20 and transfer roller 21, at which time the toner image is transferred from the photosensitive drum 20 onto the sheet S, forming an image on the sheet S.

Next, the sheet S passes between the heating roller 38 and pressure roller 39. At this time, the heating roller 38 and pressure roller 39 apply heat and pressure to the sheet S to thermally fix the image to the sheet S.

The sheet S is subsequently conveyed toward discharge rollers 40. The discharge rollers 40 discharge the sheet S onto a discharge tray 41 formed on a top surface of the main casing 2.

In this way, the sheet S is supplied from the sheet-supporting part 9 and conveyed along a conveying path that has a general C-shape in a side view, passing first between the photosensitive drum 20 and transfer roller 21 (nip part) and next between the heating roller 38 and pressure roller 39, and subsequently being discharged onto the discharge tray 41.

2. Drum Cartridge

Figure 2:
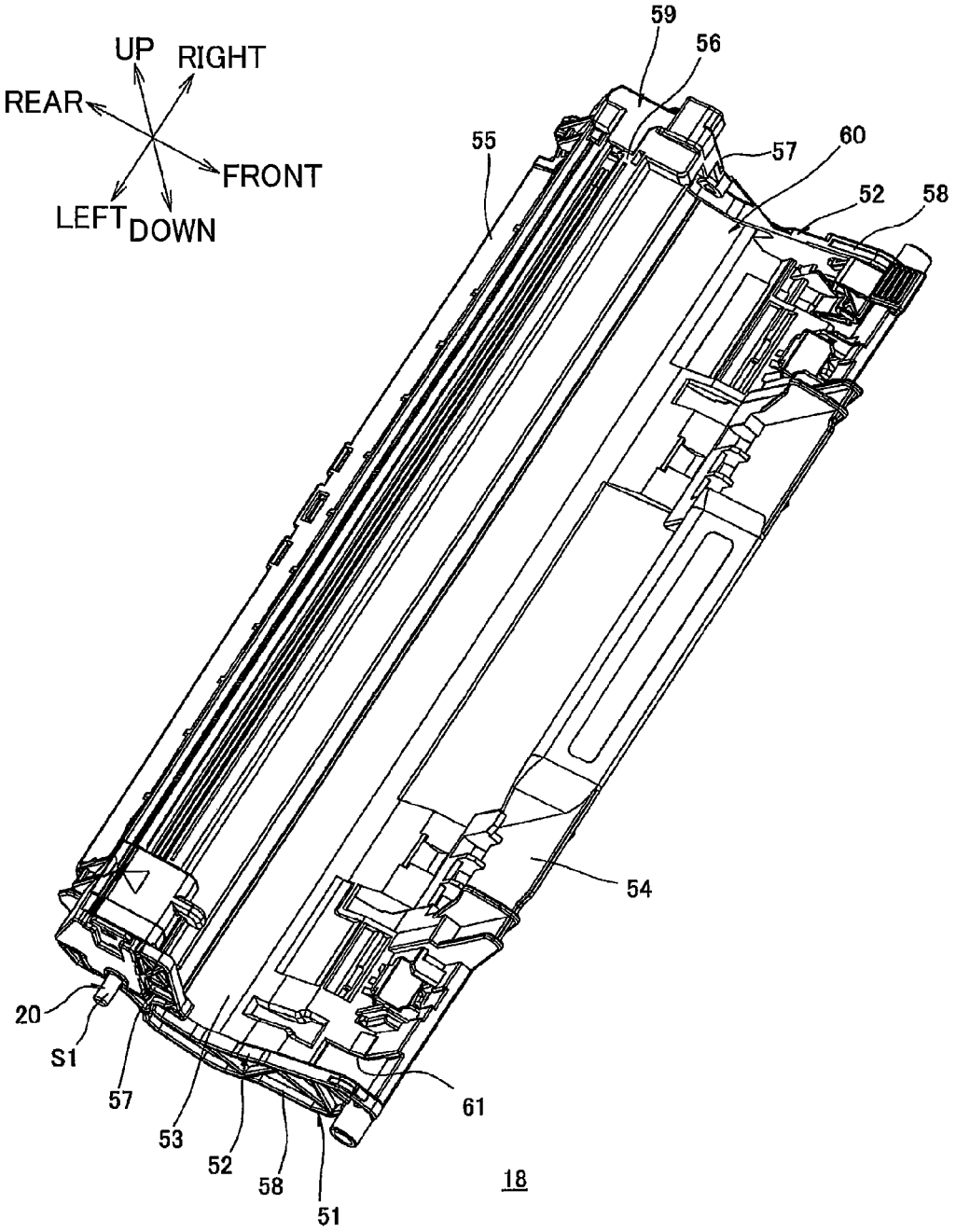
FIG. 2 is a perspective view of a drum cartridge shown in FIG. 1 as viewed from its upper-left side.
Figure 3:
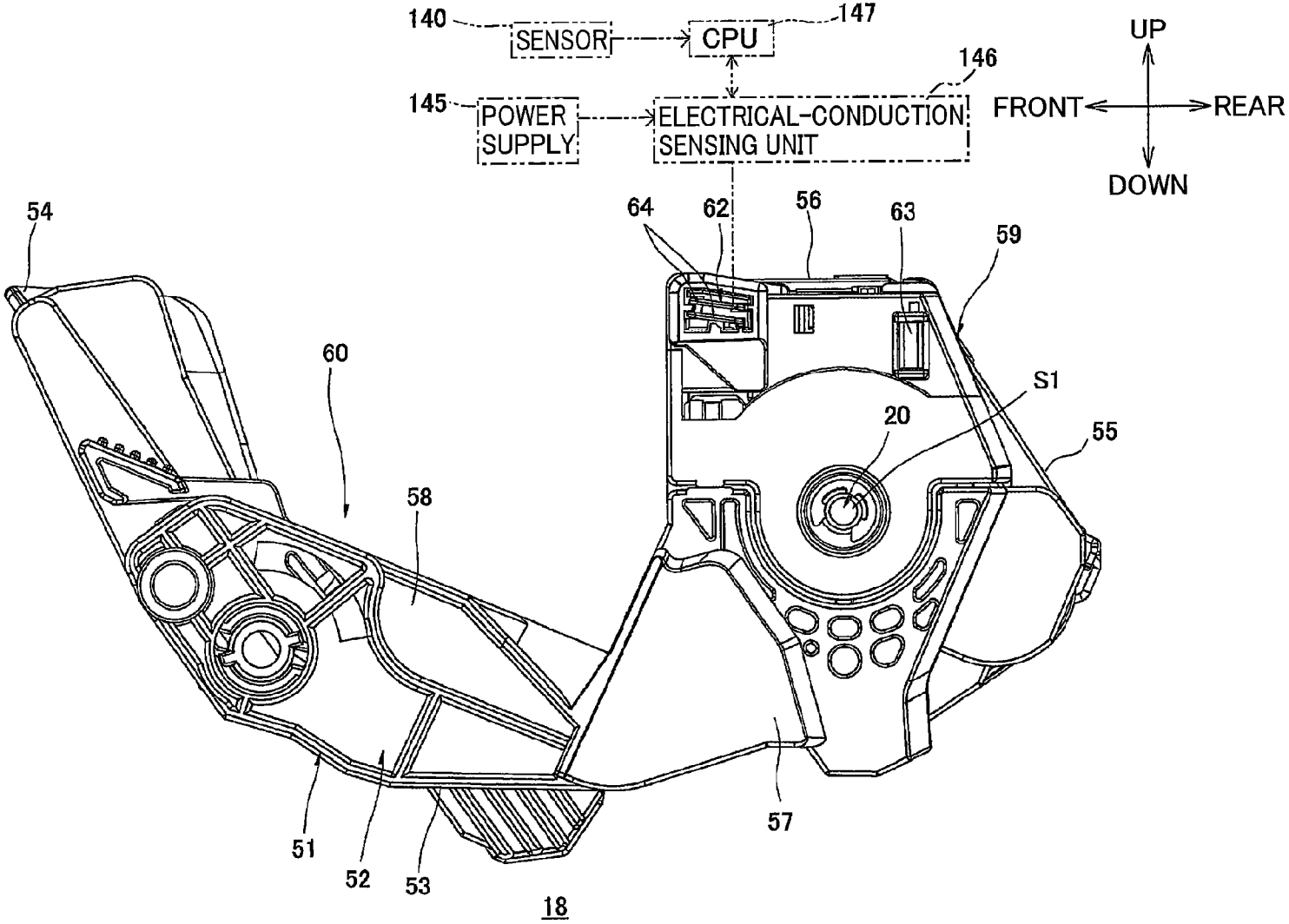
FIG. 3 is a right side view of the drum cartridge shown in FIG. 2.

As shown in FIGS. 2 and 3, the drum cartridge 18 includes a drum-cartridge frame 51.

In the following description of the drum cartridge 18, directions will be given under an assumption that the side of the drum cartridge 18 in which the photosensitive drum 20 is provided is the rear side, and the side in which the scorotron charger 22 is provided is the top. That is, up, down, front, and rear directions related to the drum cartridge 18 (FIGS. 2 through 12) differ slightly from the up, down, front, and rear directions related to the printer 1 (FIGS. 1 and 13 through 20). When the drum cartridge 18 is mounted in the printer 1, the rear side of the drum cartridge 18 faces the upper rear side of the printer 1, and the front side of the drum cartridge 18 faces the lower front side of the printer 1.

The drum-cartridge frame 51 is provided with a pair of left and right side walls 52, a bottom wall 53, a front wall 54, a rear wall 55, and a top wall 56.

Each of the side walls 52 is formed in a general plate shape that is elongated in the front-rear direction. Each side wall 52 is integrally provided with a rear part 57 constituting the rear half of the side wall 52, and a front part 58 constituting the front half.

The rear part 57 is formed in a general rectangular shape in a side view and is elongated vertically. A wire electrode 62 and a grid electrode 63 are provided on the rear part 57 of the right side wall 52.

The wire electrode 62 is disposed in an upper-front end portion of the rear part 57. The wire electrode 62 has contacts 64 that extend linearly in the front-rear direction. The wire electrode 62 is electrically connected to the charging wire 23.

The grid electrode 63 is disposed in an upper-rear end portion of the rear part 57. The grid electrode 63 is formed in a plate shape that is generally rectangular in a side view and elongated vertically. The grid electrode 63 is electrically connected to the grid 24.

The front part 58 is formed in a rectangular shape in a side view and extends continuously forward from a front edge on a lower portion of the rear part 57.

The bottom wall 53 is formed in a general plate shape that extends in the front-rear and left-right directions. The bottom wall 53 bridges bottom edges of the side walls 52.

The front wall 54 is formed in a general plate shape and extends continuously upward from a front edge of the bottom wall 53. The front wall 54 bridges front edges of the side walls 52.

The rear wall 55 bridges rear edges of the side walls 52. The rear wall 55 is formed in a general plate shape, and extends continuously upward from a rear edge of the bottom wall 53 and then bends in a direction sloping forward toward the top. The transfer roller 21 described above is rotatably supported to the inside (forward of) the rear wall 55.

The top wall 56 is disposed on the top of the drum-cartridge frame 51. The top wall 56 is formed in a general plate shape that extends forward from a top edge of the rear wall 55. The scorotron charger 22 described above is supported to the inside of (beneath) the top wall 56.

In this drum cartridge 18, a rear portion of the bottom wall 53, the rear wall 55, the top wall 56, and the rear parts 57 of the side walls 52 define a drum-accommodating section 59 that accommodates the photosensitive drum 20.

The photosensitive drum 20 is rotatably supported in the rear parts 57 of the side walls 52 at the corresponding left and right ends of the drum shaft S1. Note that the left and right ends of the drum shaft S1 penetrate the rear parts 57 of the respective side walls 52 and protrude outward respectively in the left-right direction.

Further, the bottom wall 53, front wall 54, and front parts 58 of the side walls 52 in the drum cartridge 18 define a cartridge-mounting section 60 in which the developing cartridge 19 is mounted. A detectable-gear exposure opening 61 is formed in the cartridge-mounting section 60.

The detectable-gear exposure opening 61 is formed in a lower front region of the drum-cartridge frame 51 at the left edge thereof. The detectable-gear exposure opening 61 penetrates a region extending across the front edge of the bottom wall 53 and the bottom edge of the front wall 54, forming a general rectangular shape in a plan view that is elongated in the front-rear direction.

3. Developing Cartridge

Figure 4:
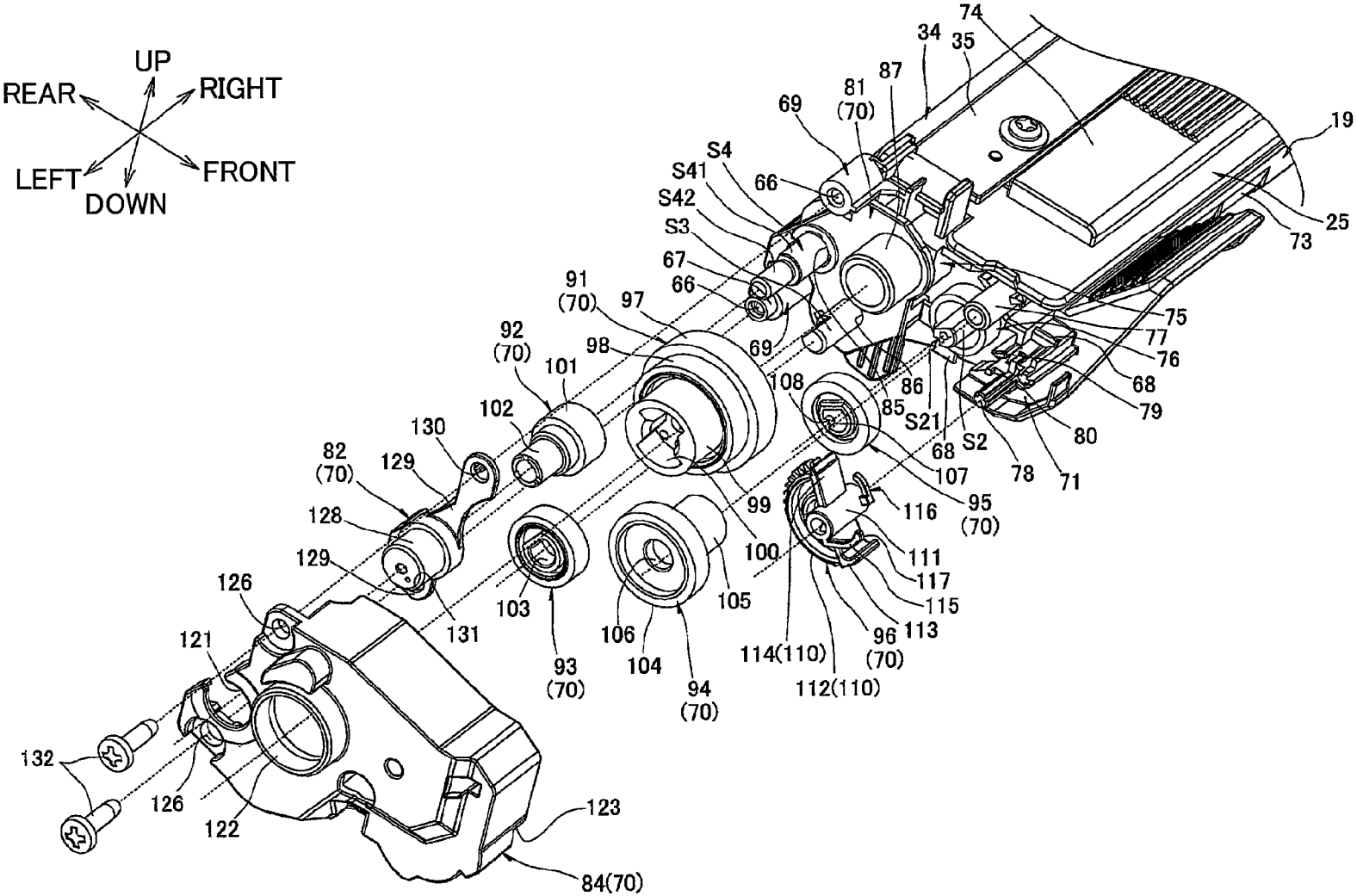
FIG. 4 is an exploded perspective view of a developing cartridge shown in FIG. 1 as viewed from its front-left side.

As shown in FIG. 4, the developing cartridge 19 includes the developing-cartridge frame 25 described above, and a drive unit 70 arranged on the left side of the developing-cartridge frame 25. A power supply unit (not shown) is provided on the right side of the developing-cartridge frame 25 for supplying power to the developing cartridge 19.

In the following description of the developing cartridge 19, directions related to the developing cartridge 19 will be given under an assumption that the side of the developing cartridge 19 in which the developing roller 34 is provided is the rear side, and the side in which the thickness-regulating blade 35 is provided is the top. That is, up, down, front, and rear directions related to the developing cartridge 19 differ slightly from the up, down, front, and rear directions related to the printer 1. When the developing cartridge 19 is mounted in the printer 1, the rear side of the developing cartridge 19 faces the upper rear side of the printer 1, and the front side of the developing cartridge 19 faces the lower front side of the printer 1.

(1) Developing-Cartridge Frame

The developing-cartridge frame 25 is formed in a box-like shape that is elongated in the left-right direction. More specifically, the developing-cartridge frame 25 includes a pair of left and right side walls 71, the bottom wall 72, a front wall 73, and a top wall 74. The side walls 71 are disposed apart from each other in the left-right direction, with one on either side of the toner-accommodating chamber 26. Below, a detailed description of the left side wall 71 that supports the drive unit 70 will be given while a description of the right side wall 71 will be omitted. Further, the left side wall 71 will simply be called the side wall 71.

The side wall 71 is formed in a general rectangular shape in a side view and is elongated in the front-rear direction. Formed on the side wall 71 are a seal-accommodating part 75, an agitator-shaft exposure part 76, an idle-gear support part 77, a detectable-gear support part 78, a drive-detection engageable part 79 as an example of a second engaged part, and an engageable boss 80.

The seal-accommodating part 75 is formed in a general cylindrical shape that is closed on the left end. The seal-accommodating part 75 protrudes leftward from a left surface of the side wall 71 on the rear side of the side wall 71 at a position aligned with the development chamber 27. A developing-roller-shaft exposure hole (not shown) that exposes the left end of the developing roller shaft S4 and a supply-roller-shaft exposure hole (not shown) that exposes the left end of the supply roller shaft S3 are formed in a left wall of the seal-accommodating part 75, penetrating the left wall. A sealing member (not shown) is provided in the supply-roller-shaft exposure hole (not shown) for sealing a gap between the outer peripheral surface of the supply roller shaft S3 and an inner peripheral surface of the supply-roller-shaft exposure hole (not shown).

A gear fitting part S41 and a collar fitting part S42 are provided on the left end of the developing roller shaft S4 that is exposed on the left side of the seal-accommodating part 75.

The gear fitting part S41 is formed with a general D-shaped cross section.

The collar fitting part S42 extends leftward from a left endface of the gear fitting part S41. The collar fitting part S42 is formed in a general columnar shape with a smaller diameter than the gear fitting part S41.

The left end of the supply roller shaft S3 exposed on the left side of the seal-accommodating part 75 is formed with a general D-shaped cross section.

The agitator-shaft exposure part 76 is formed in a general cylindrical shape in a side view and is positioned on the front side of the seal-accommodating part 75.

Figure 10:
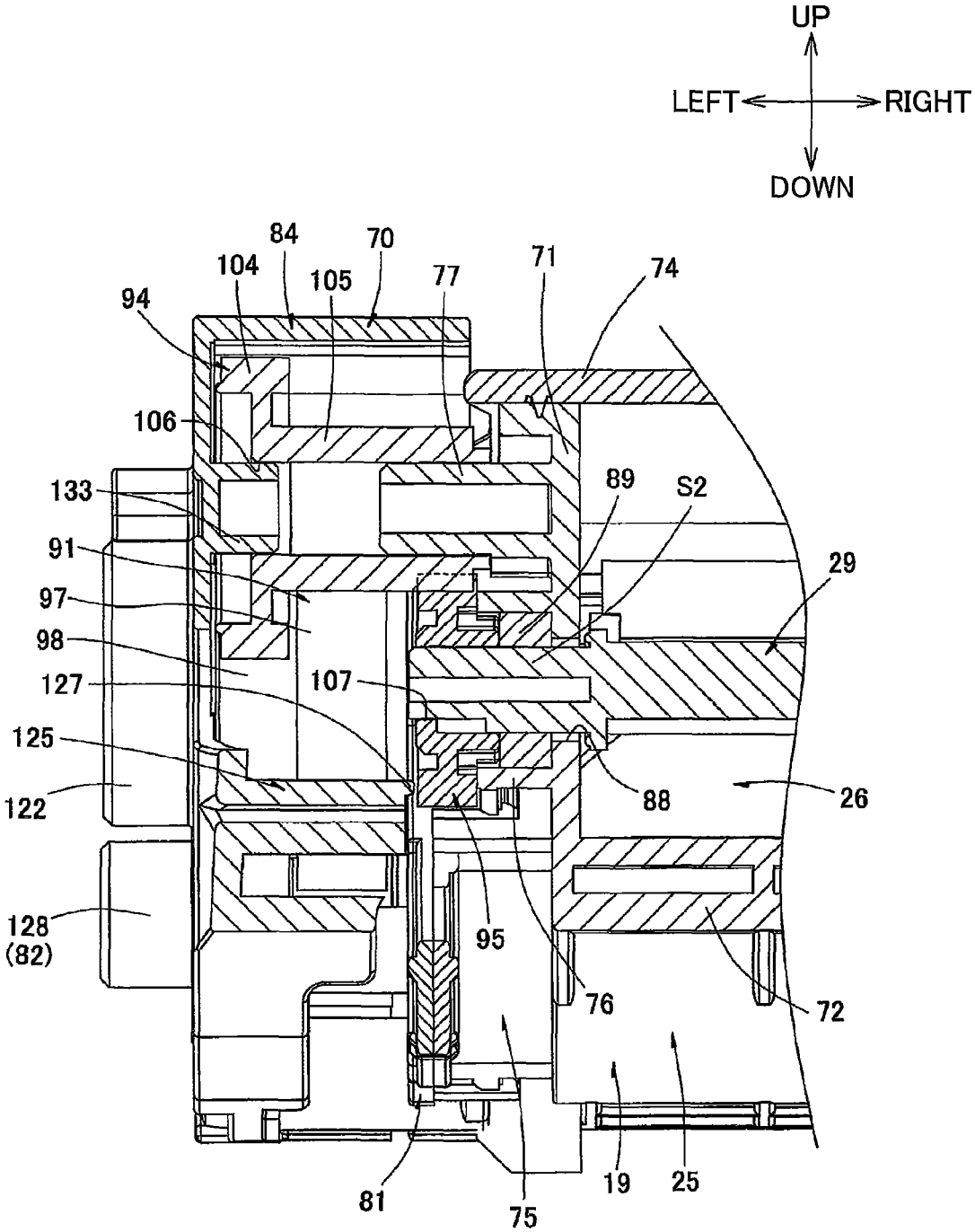
FIG. 10 is a cross-sectional view of the developing cartridge shown in FIG. 8 taken along a plane A-A.

As shown in FIG. 10, an agitator-shaft insertion hole 88 penetrates the side wall 71 at a position within the agitator-shaft exposure part 76. An agitator-shaft seal 89 is also provided inside the agitator-shaft exposure part 76 on the left side of the side wall 71.

The agitator-shaft insertion hole 88 is formed with a general circular shape in a side view. The agitator-shaft insertion hole 88 has a larger inner diameter than an outer diameter of the agitator shaft S2 at the left and right ends thereof. The left end of the agitator shaft S2 passes through the agitator-shaft insertion hole 88 and is exposed on the left side of the side wall 71.

The left end of the agitator shaft S2 exposed on the left side of the agitator-shaft insertion hole 88 is formed with a general D-shaped cross section. A recess S21 is formed in the left surface of the agitator shaft S2 exposed on the left side of the agitator-shaft insertion hole 88. The recess S21 is formed in a general semicircular shape in a side view and is recessed radially inward from the circumferential surface of the agitator shaft S2.

The agitator-shaft seal 89 is formed of a sponge or other elastic material having a general annular shape with substantial thickness in the left-right dimension. The agitator-shaft seal 89 is fitted inside the agitator-shaft exposure part 76 to be fitted around the agitator shaft S2 on the right side of the generally D-shaped cross-sectional part (fitted over the agitator shaft S2 from the radial outer side thereof).

As shown in FIG. 4, the idle-gear support part 77 is formed in a general columnar shape. The idle-gear support part 77 protrudes leftward from the left surface of the side wall 71 at a position above and frontward of the agitator-shaft exposure part 76.

The detectable-gear support part 78 is formed in a columnar shape that is generally plus-sign-shaped in a side view. The detectable-gear support part 78 protrudes leftward from the left surface of the side wall 71 at a position below and frontward of the idle-gear support part 77. The detectable-gear support part 78 protrudes farther leftward than the idle-gear support part 77.

The drive-detection engageable part 79 is formed in a general square columnar shape and protrudes leftward from the left surface of the side wall 71 at a position between the idle-gear support part 77 and detectable-gear support part 78. The drive-detection engageable part 79 has a left endface that slopes leftward toward the upper rear side. The left end of the drive-detection engageable part 79 is positioned rightward than the left end of the detectable-gear support part 78.

The engageable boss 80 is formed in a general square columnar shape and protrudes leftward from the left surface of the side wall 71 at a position below the drive-detection engageable part 79. The left end of the engageable boss 80 is positioned rightward than the left end of the detectable-gear support part 78.

The side wall 71 is also provided with a plurality (2 in the preferred embodiment) of engageable parts 68, and a plurality (2 in the preferred embodiment) of threaded parts 69.

Figure 6:
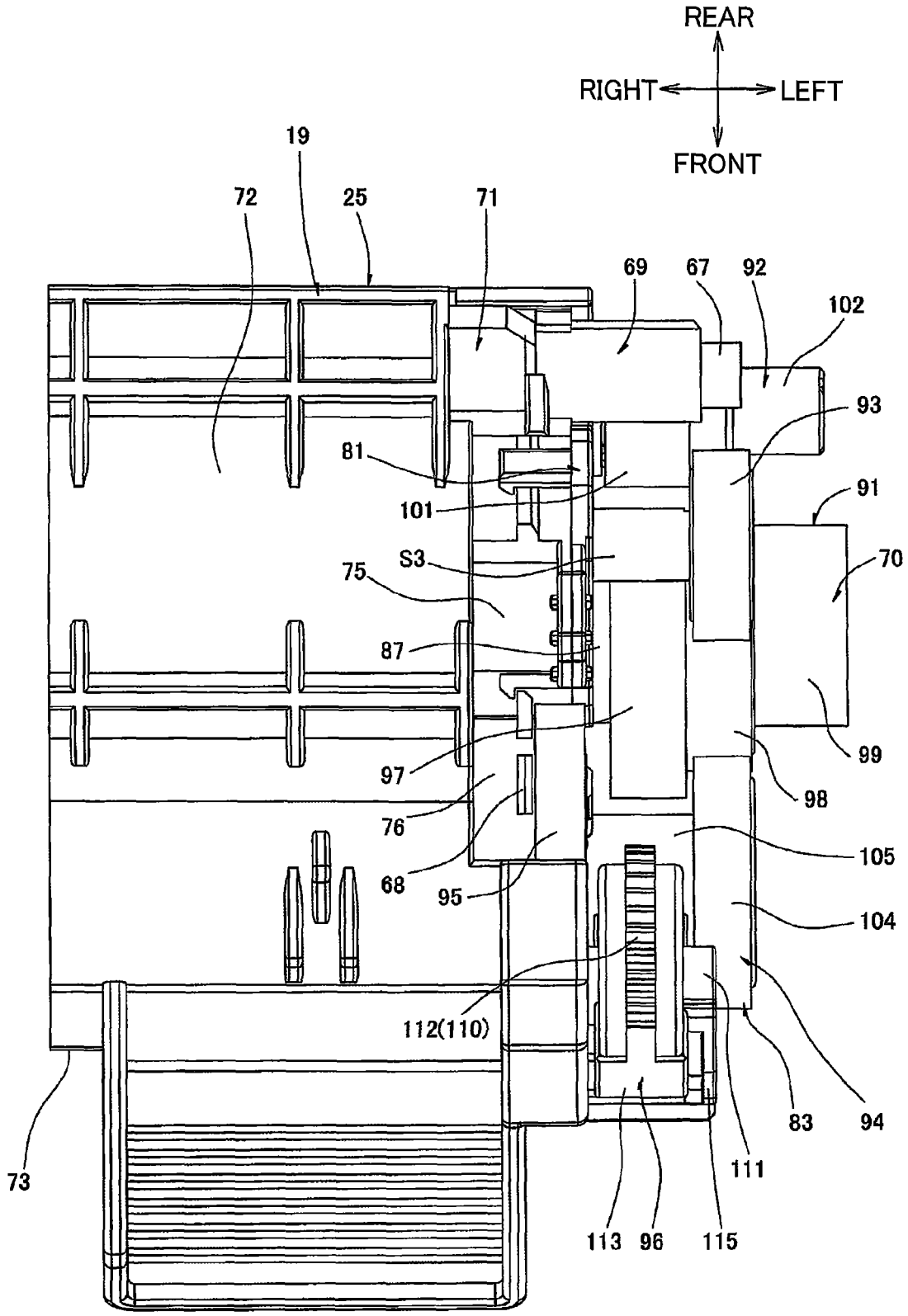
FIG. 6 is a bottom view of the developing cartridge shown in FIG. 1.

One of the engageable parts 68 is provided above the detectable-gear support part 78, and the other is provided below the agitator-shaft exposure part 76 (see FIG. 6).

The upper engageable part 68 protrudes leftward from the left surface of the side wall 71 above the detectable-gear support part 78. The left end of the upper engageable part 68 bends upward to form a hook-like shape.

The lower engageable part 68 protrudes downward from a bottom surface of the agitator-shaft exposure part 76 on the left end thereof. The lower engageable part 68 has a ridge-like shape that extends in the front-rear direction (see FIGS. 6 and 9).

One of the threaded parts 69 is provided in an upper rear corner of the side wall 71, and the other is provided in a lower rear corner of the side wall 71. Each threaded part 69 has a general columnar shape and protrudes leftward from the left surface of the side wall 71. A screw hole 66 is formed in each threaded part 69 as a rightward recess in a left surface thereof. Further, a reduced-diameter part 67 is formed on the lower threaded part 69.

The reduced-diameter part 67 is formed in a general cylindrical shape on the left endface of the lower threaded part 69. The reduced-diameter part 67 extends leftward from a peripheral edge of the screw hole 66. The reduced-diameter part 67 has an outer diameter smaller than the outer diameter of a portion of the threaded part 69 right of the reduced-diameter part 67.

The bottom wall 72 is formed in a general plate shape that is elongated in the front-rear direction. The left and right edges of the bottom wall 72 are formed continuously with the bottom edges of the side walls 71 (see FIG. 5).

The front wall 73 is formed in a general plate shape that extends continuously upward from the front edge of the bottom wall 72. Left and right edges of the front wall 73 are formed continuously with the front edges of the side walls 71.

The top wall 74 is formed in a general plate shape that is elongated in the front-rear and left-right directions. The top wall 74 is disposed to confront the top edges of the side walls 71 and front wall 73 from above. Peripheral edges of the top wall 74 are fixed to the top edges of the side walls 71 and front wall 73 through a method such as welding.

(2) Drive Unit

The drive unit 70 includes a bearing member 81, a gear train 83 (see FIG. 5), a collar member 82, and a gear cover 84 as an example of a cover member.

(2-1) Bearing Member

The bearing member 81 is supported to the developing-cartridge frame 25 on the left side of the seal-accommodating part 75. The bearing member 81 is formed in a general plate shape that extends vertically. Formed in the bearing member 81 are a developing-roller-shaft insertion hole 85, and a supply-roller-shaft insertion hole 86. The bearing member 81 further includes a coupling support part 87.

The developing-roller-shaft insertion hole 85 is formed with a general circular shape in a side view and penetrates a rear portion of the bearing member 81. The developing-roller-shaft insertion hole 85 has an inner diameter approximately equal to (slightly larger than) the outer diameter of the developing roller shaft S4.

The supply-roller-shaft insertion hole 86 is formed with a general circular shape in a side view and penetrates a portion of the bearing member 81 at a position below and forward of the developing-roller-shaft insertion hole 85. The supply-roller-shaft insertion hole 86 has an inner diameter approximately equal to (slightly larger than) the outer diameter of the supply roller shaft S3.

The coupling support part 87 is formed in a general columnar shape at a position forward of the developing-roller-shaft insertion hole 85 and above the supply-roller-shaft insertion hole 86. The coupling support part 87 protrudes leftward from a left surface of the bearing member 81.

(2-2) Gear Train

Figure 5:
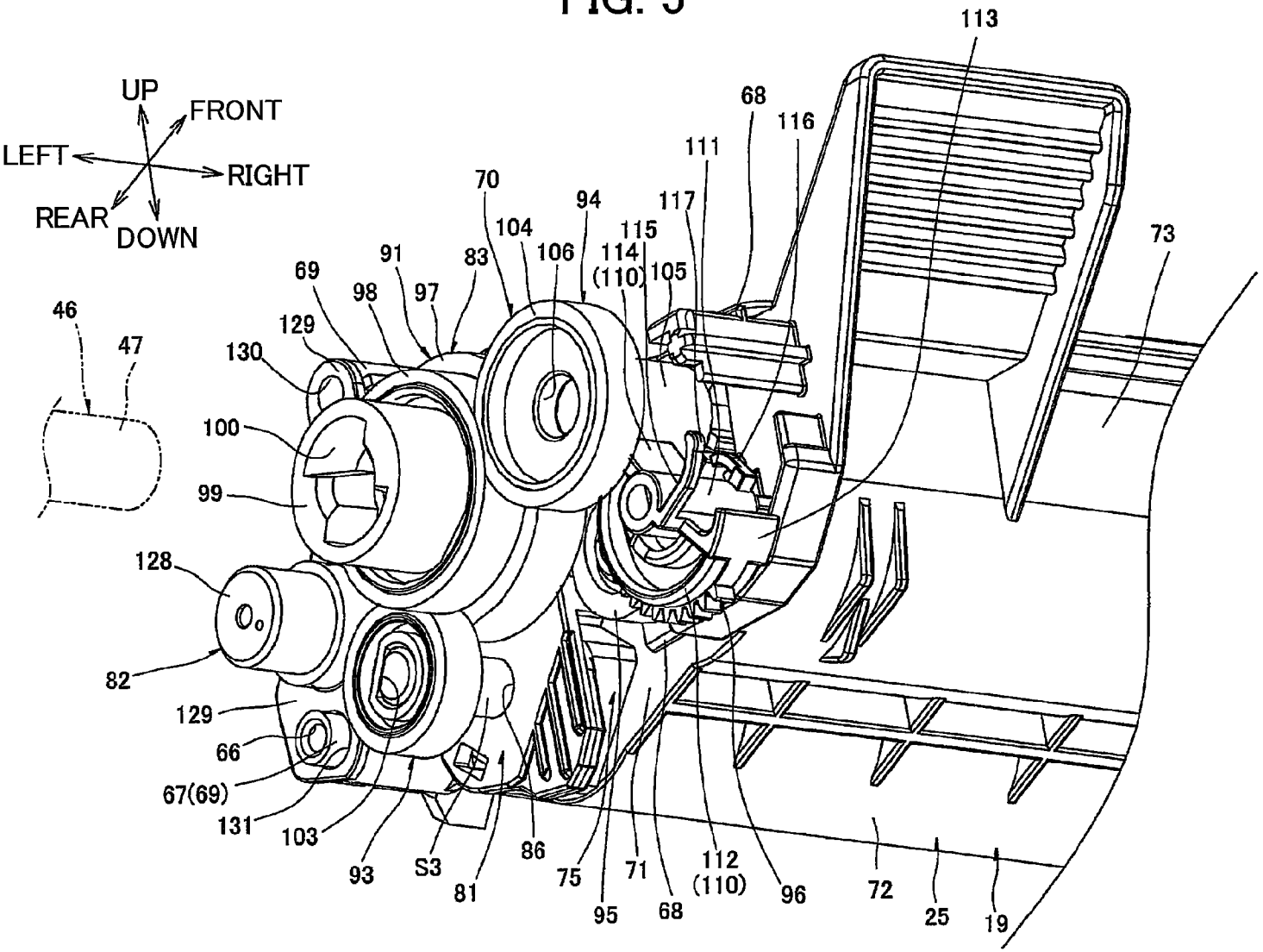
FIG. 5 is a perspective view of the developing cartridge shown in FIG. 1 as viewed from its front-left side, wherein a gear cover is removed.

As shown in FIGS. 4 and 5, the gear train 83 includes a development coupling 91, a development gear 92, a supply gear 93, an idle gear 94 as an example of a drive-force transmission member, an agitator gear 95, and a detectable gear 96 as an example of a detected member.

The development coupling 91 is formed in a general columnar shape that is elongated in the left-right direction. The development coupling 91 integrally includes a large-diameter gear part 97, a small-diameter gear part 98, and a coupling part 99.

The large-diameter gear part 97 is formed in a general disc shape having a substantial thickness in the left-right dimension. The large-diameter gear part 97 constitutes a right end of the development coupling 91. A through-hole (not shown) having a diameter greater than (substantially equal to) the outer diameter of the coupling support part 87 is formed in a radial center of the large-diameter gear part 97. Gear teeth are formed around an entire circumferential surface of the large-diameter gear part 97.

The small-diameter gear part 98 is formed in a general columnar shape and protrudes leftward from a left surface of the large-diameter gear part 97 so as to surround the through-hole (not shown) of the large-diameter gear part 97. The small-diameter gear part 98 has an outer diameter smaller than the outer diameter of the large-diameter gear part 97. The small-diameter gear part 98 has an inner diameter larger than the through-hole (not shown) formed in the large-diameter gear part 97. Further, the small-diameter gear part 98 has a central axis coincident with a central axis of the large-diameter gear part 97. Gear teeth are formed around an entire circumferential surface of the small-diameter gear part 98. The number of teeth formed on the small-diameter gear part 98 is fewer than the number of teeth on the large-diameter gear part 97.

The coupling part 99 is disposed on the radial inside of the small-diameter gear part 98. The coupling part 99 is formed continuously with the left surface of the large-diameter gear part 97 and has a general cylindrical shape that is closed on the left end. The coupling part 99 protrudes leftward from a peripheral edge of the through-hole (not shown) formed in the large-diameter gear part 97. The coupling part 99 has an outer diameter smaller than the inner diameter of the small-diameter gear part 98. The coupling part 99 has an inner diameter that is equivalent to the inner diameter of the through-hole (not shown) of the large-diameter gear part 97. The central axis of the coupling part 99 is coincident with the central axis of the large-diameter gear part 97. A coupling recess 100 is also formed in a left surface of the coupling part 99.

The coupling recess 100 is formed in a general shape of an elongate hole in a side view that is elongated in a radial direction of the development coupling 91. The coupling recess 100 is recessed rightward from the left surface of the development coupling 91. A coupling protrusion 47 (see FIG. 5) of a main coupling 46 (see FIG. 5) provided in the main casing 2 is fitted into the coupling recess 100 for transmitting a drive force.

The development gear 92 is formed in a general cylindrical shape that is elongated in the left-right direction. The development gear 92 integrally possesses a gear part 101, and a collar insertion part 102.

The gear part 101 constitutes a right end of the development gear 92. The gear part 101 is formed in a general disc shape with a substantial thickness in the left-right direction. A through-hole (not shown) is formed in a radial center of the gear part 101. The through-hole has a general D-shape in a side view and can receive the left end of the developing roller shaft S4. Gear teeth are formed around an entire circumferential surface of the gear part 101.

The collar insertion part 102 is formed in a general cylindrical shape and protrudes continuously leftward from a left end of the gear part 101. The collar insertion part 102 has an outer diameter smaller than the outer diameter of the gear part 101. The central axis of the collar insertion part 102 is coincident with the central axis of the gear part 101.

The supply gear 93 is formed in a general disc shape having a substantial thickness in the left-right direction. A supply-roller-shaft fitting hole 103 is formed in the supply gear 93 to penetrate a radial center thereof. The supply-roller-shaft fitting hole 103 has a general D-shape in a side view and can receive the left end of the supply roller shaft S3. Gear teeth extending in the left-right direction are formed around an entire circumferential surface of the supply gear 93.

The idle gear 94 is formed in a general cylindrical shape that is elongated in the left-right direction. The idle gear 94 integrally possesses a large-diameter part 104, and a small-diameter part 105.

The large-diameter part 104 constitutes a left end portion of the idle gear 94. The large-diameter part 104 is formed in a general disc shape having a substantial thickness in the left-right direction. A fitting hole 106 penetrates a radial center of the large-diameter part 104. The fitting hole 106 is formed in a general circular shape in a side view. The large-diameter part 104 has an outer diameter smaller than the outer diameter of the small-diameter gear part 98 of the development coupling 91. Gear teeth are formed around an entire peripheral surface of the large-diameter part 104. The number of teeth formed on the large-diameter part 104 is fewer than the number formed on the small-diameter gear part 98 of the development coupling 91.

The small-diameter part 105 is formed on a right endface of the large-diameter part 104 and has a general cylindrical shape that extends rightward from the peripheral edge of the fitting hole 106. The outer diameter of the small-diameter part 105 is smaller than the outer diameter of the large-diameter part 104. The small-diameter part 105 shares a central axis with the large-diameter part 104. Gear teeth are formed around an entire peripheral surface of the small-diameter part 105. The number of teeth formed on the small-diameter part 105 is fewer than the number of teeth on the large-diameter part 104.

The agitator gear 95 is formed in a general disc shape having a substantial thickness in the left-right direction. An agitator-shaft fitting hole 107 penetrates a radial center of the agitator gear 95. The agitator-shaft fitting hole 107 is formed with a general D-shape in a side view and can receive the left end of the agitator shaft S2. Gear teeth are formed around an entire circumferential surface of the agitator gear 95. A protrusion 108 is also provided in the agitator-shaft fitting hole 107 formed in the agitator gear 95.

The protrusion 108 is formed at a left end of the agitator-shaft fitting hole 107. The protrusion 108 has a general semicircular shape in a side view and protrudes inward from an inner circumferential surface of the agitator-shaft fitting hole 107 (inward in a radial direction of the agitator-shaft fitting hole 107). The outer diameter of the protrusion 108 is smaller than the inner diameter of the recess S21 formed in the agitator shaft S2.

Figure 11:
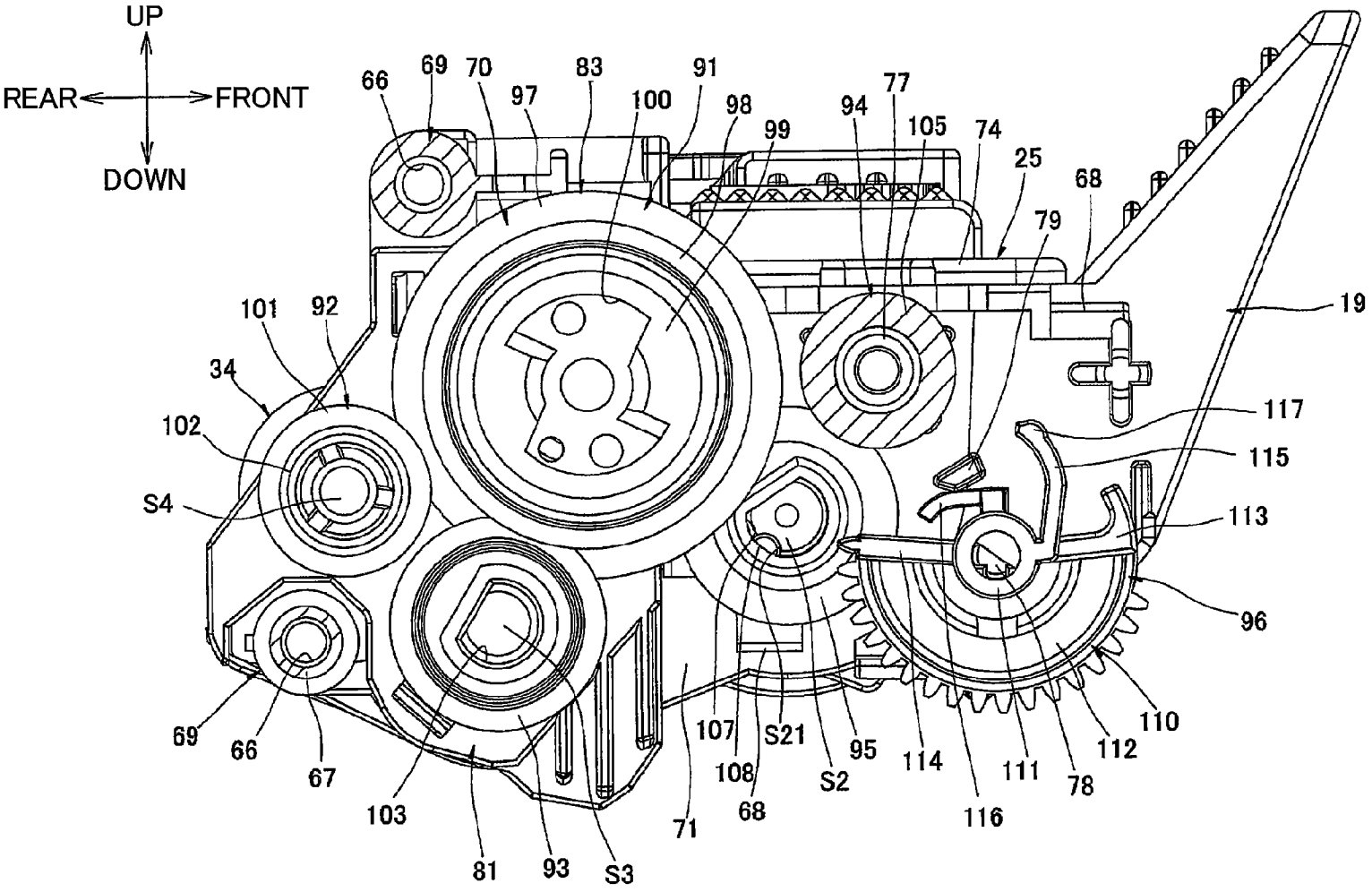
FIG. 11 is an explanatory view explaining arrangement of a detectable gear when a drive test is executed for the developing cartridge.

The detectable gear 96 is formed in a general semicircular disc shape having a substantial thickness in the left-right direction. More specifically, as shown in FIGS. 4 and 11, the detectable gear 96 includes a shaft part 111, a toothed part 112, a first contact part 113 as an example of a second detected part, a second contact part 114 as an example of a first detected part, a first engaging part 115, and a second engaging part 116.

The shaft part 111 is disposed in a radial center of the detectable gear 96. The shaft part 111 is formed in a general cylindrical shape that is elongated in the left-right direction. The shaft part 111 has an inner diameter larger than (approximately equal to) the outer diameter of the detectable-gear support part 78.

The toothed part 112 forms an outer shape of the detectable gear 96. The toothed part 112 is formed in a general semicylindrical disc shape having a substantial thickness in the left-right direction. The left-right dimension of the toothed part 112 is smaller than the left-right dimension of the shaft part 111. Gear teeth extending in the left-right direction are formed on a circumferential surface of the toothed part 112.

The first contact part 113 is formed on an upstream edge of the toothed part 112 and continues upstream therefrom in a clockwise direction (first direction) in a left side view. Thus, the first contact part 113 is disposed at the same positon as the toothed part 112 in the left-right direction. The first contact part 113 is formed in a general plate shape that extends first radially outward from the shaft part 111 (i.e., outward in a radial direction of the detectable gear 96; hereinafter it should be assumed that a radial direction of the shaft part 111 is the radial direction of the detectable gear 96), and then bends upstream in the clockwise direction in a left side view. The left-right dimension of the first contact part 113 is greater than the left-right dimension of the toothed part 112 but smaller than the left-right dimension of the shaft part 111.

The second contact part 114 is formed on a downstream edge of the toothed part 112 and continues downstream therefrom in the clockwise direction in a left side view. Thus, the second contact part 114 occupies the same left-right position as the toothed part 112. The second contact part 114 is formed in a general plate shape that extends radially outward from the shaft part 111. A gear tooth extending in the left-right direction is also formed on an outer radial edge of the second contact part 114 so as to continue the sequence of the gear teeth formed on the toothed part 112. Together with the toothed part 112, the second contact part 114 having this structure constitutes a passive part 110 as an example of a receiving part. The left-right dimension of the second contact part 114 is equal to the left-right dimension of the first contact part 113.

The first engaging part 115 is formed in a rail-like shape that protrudes radially outward from the left end of the shaft part 111 (toward the side opposite the toothed part 112) while bending. More specifically, the first engaging part 115 is positioned such that its end on the shaft part 111 side overlaps the first contact part 113 in a left-right projection. After protruding radially outward from the left end of the shaft part 111 a slight distance, the first engaging part 115 bends and extends linearly upstream in the clockwise direction in a left side view so as to form an approximate right angle with the first contact part 113. Near its distal end (free end), the first engaging part 115 curves further upstream in the clockwise direction in a left side view. A sliding part 117 is also provided on the distal end of the first engaging part 115 as an example of a contact end.

The sliding part 117 constituting the distal end of the first engaging part 115 is formed in a general arc shape in a side view, with its convex side protruding radially outward from the shaft part 111.

The second engaging part 116 is formed in a rail-like shape that extends radially outward from a right end of the shaft part 111 while bending. More specifically, the second engaging part 116 is provided on the side of the shaft part 111 opposite the toothed part 112 at a position between the first contact part 113 and second contact part 114. After protruding radially outward from the right end of the shaft part 111 a slight distance, the second engaging part 116 bends upstream in the clockwise direction in a left side view and extends linearly and approximately parallel to the second contact part 114. Near its distal end (free end), the second engaging part 116 curves further upstream in the clockwise direction in a left side view.

(2-3) Assembled State of the Gear Train

As shown in FIGS. 4 and 5, the development coupling 91 is rotatably supported on the coupling support part 87 of the bearing member 81.

The development gear 92 is disposed on the left side of the bearing member 81 and is fitted over the left end of the developing roller shaft S4 (fitted around the radial outside of the developing roller shaft S4) so as to be incapable of rotating relative to the developing roller shaft S4 by fitting the gear fitting part S41 of the developing roller shaft S4 in a fitting hole (not shown) formed in the gear part 101 and by fitting the collar fitting part S42 of the developing roller shaft S4 into the collar insertion part 102. The gear part 101 of the development gear 92 is engaged with the large-diameter gear part 97 of the development coupling 91 from the lower rear side thereof.

The supply gear 93 is disposed on the left side of the bearing member 81 and is supported on the left end of the supply roller shaft S3 so as to be incapable of rotating relative to the supply roller shaft S3 by fitting the left end of the supply roller shaft S3 into the supply-roller-shaft fitting hole 103 of the supply gear 93. The supply gear 93 is spaced apart from the lower front side of the development gear 92 and is engaged with the small-diameter gear part 98 of the development coupling 91 from the lower rear side thereof.

The idle gear 94 is rotatably supported on the idle-gear support part 77 of the developing-cartridge frame 25 at the small-diameter part 105. The large-diameter part 104 of the idle gear 94 is engaged with the small-diameter gear part 98 of the development coupling 91 from the front side thereof. Here, the small-diameter part 105 of the idle gear 94 is separated from the front side of the large-diameter gear part 97 of the development coupling 91 (see FIG. 12).

The agitator gear 95 is disposed on the left side of the left side wall 71 constituting the developing-cartridge frame 25 and on the right side of the development coupling 91, and is frontward of the seal-accommodating part 75 and rearward of the small-diameter part 105 constituting the idle gear 94. The agitator gear 95 is supported on the left end of the agitator shaft S2 so as to be incapable of rotating relative to the agitator shaft S2 by fitting the left end of the agitator shaft S2 in the agitator-shaft fitting hole 107 of the agitator gear 95 and fitting the protrusion 108 into the recess S21 formed in the agitator shaft S2. The agitator gear 95 is engaged with the right end of the small-diameter part 105 constituting the idle gear 94 from the lower rear side thereof (see FIG. 6)

The detectable gear 96 is rotatably supported on the detectable-gear support part 78 of the developing-cartridge frame 25. Hence, the detectable gear 96 can rotate about the central axis of the detectable-gear support part 78 (first axis). The detectable gear 96 is engaged with the left end of the small-diameter part 105 constituting the idle gear 94 from the lower front side thereof through gear teeth formed on the second contact part 114 of the detectable gear 96 (see FIGS. 12 and 14).

(2-4) Collar Member

The collar member 82 is provided with a collar part 128, and a plurality (2 in the preferred embodiment) of fixing parts 129.

The collar part 128 is formed in a general cylindrical shape that is elongated in the left-right direction and closed on the left end. The collar part 128 has an inner diameter approximately equal to (slightly larger than) the outer diameter of the collar insertion part 102 constituting the development gear 92.

The fixing parts 129 are provided one above and the other below the collar part 128.

The upper fixing part 129 is formed in a general plate shape that extends continuously upward from a right end of the collar part 128. A screw insertion hole 130 is formed in the upper fixing part 129.

The screw insertion hole 130 is generally circular in a side view and is formed in an upper end portion of the upper fixing part 129.

The lower fixing part 129 is formed in a general plate shape that extends continuously downward from the right end of the collar part 128. A reduced-diameter-part insertion hole 131 is formed in the lower fixing part 129.

The reduced-diameter-part insertion hole 131 has a generally elongate hole shape in a side view that is elongated in the front-rear direction and is formed in a lower end portion of the lower fixing part 129. The reduced-diameter-part insertion hole 131 has a vertical dimension that is approximately equal to (slightly larger than) the outer diameter of the reduced-diameter part 67 constituting the lower threaded part 69.

The reduced-diameter-part insertion hole 131 is fitted around the reduced-diameter part 67 of the lower threaded part 69 (fitted over the outer radial side of the reduced-diameter part 67), and the collar part 128 is fitted around the collar insertion part 102 of the development gear 92 (fitted over the outer radial side of the collar insertion part 102) so as to be incapable of rotating relative to the collar insertion part 102.

In this state, the screw insertion hole 130 of the upper fixing part 129 is aligned with the screw hole 66 of the upper threaded part 69 in the left-right direction.

(2-5) Gear Cover

Figure 7:
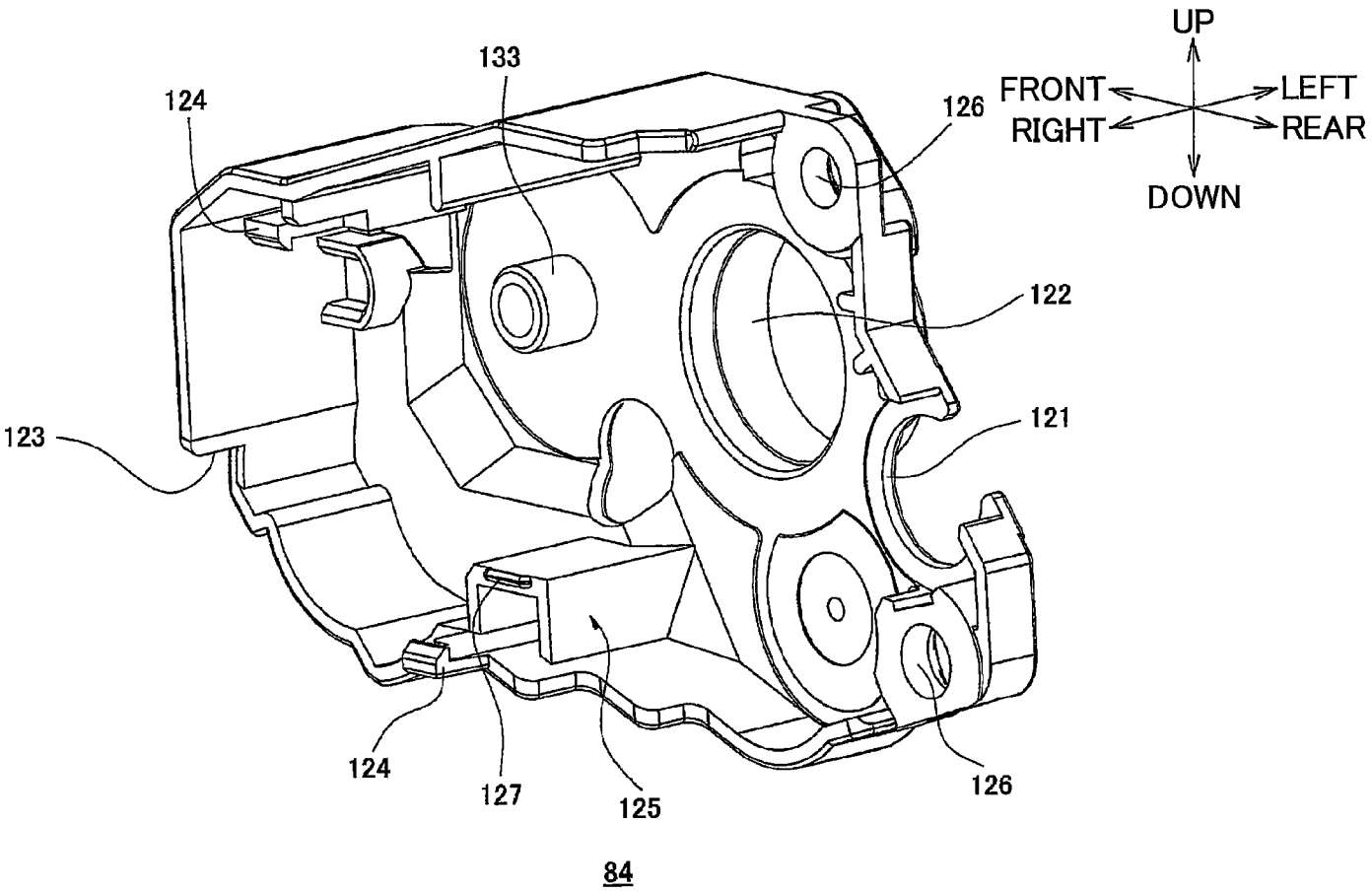
FIG. 7 is a perspective view of the gear cover shown in FIG. 4 as viewed from its rear-right side.

As shown in FIGS. 4 and 7, the gear cover 84 is formed in a general box-like shape having an open right side and a closed left side. Formed in the gear cover 84 are a collar exposure opening 121, a coupling collar 122, and a detectable-gear exposure opening 123. The gear cover 84 is also provided with an agitator-gear-restricting part 125, an idle-gear-supporting part 133, and an opposing rib 134 (see FIG. 16) as an example of a first engaged part.

The collar exposure opening 121 is formed in a rear edge of the gear cover 84 and has a general C-shape in a side view with the opening of the "C" facing obliquely upward and rearward so that the rear edge of the gear cover 84 is cut out in a direction obliquely downward and forward. The inner diameter of the collar exposure opening 121 is larger than the outer diameter of the collar member 82.

The coupling collar 122 is formed in a position diagonally above and forward of the collar exposure opening 121 and has a general cylindrical shape that extends leftward from a left wall of the gear cover 84. The right side of the coupling collar 122 is in communication with the interior (right side) of the gear cover 84.

The detectable-gear exposure opening 123 is formed in a lower-front end portion of a peripheral wall constituting the gear cover 84. The detectable-gear exposure opening 123 has a general rectangular shape in a front view so as to cut out from the inner left-right edge (right edge) of the gear cover 84 toward the outer left-right side (left side).

The agitator-gear-restricting part 125 is disposed rearward of the detectable-gear exposure opening 123. The agitator-gear-restricting part 125 is formed in a general square columnar shape that protrudes rightward from an inner surface (right surface) of the left wall of the gear cover 84. A restricting protrusion 127 is provided on the agitator-gear-restricting part 125.

The restricting protrusion 127 is provided on a top edge of the agitator-gear-restricting part 125 and protrudes rightward from a right surface thereof. The restricting protrusion 127 is a ridge that extends in the front-rear direction.

The idle-gear-supporting part 133 is disposed obliquely above and forward of the agitator-gear-restricting part 125. The idle-gear-supporting part 133 is formed in a general circular columnar shape and protrudes rightward from the inner surface (right surface) on the left wall of the gear cover 84.

Figure 16:
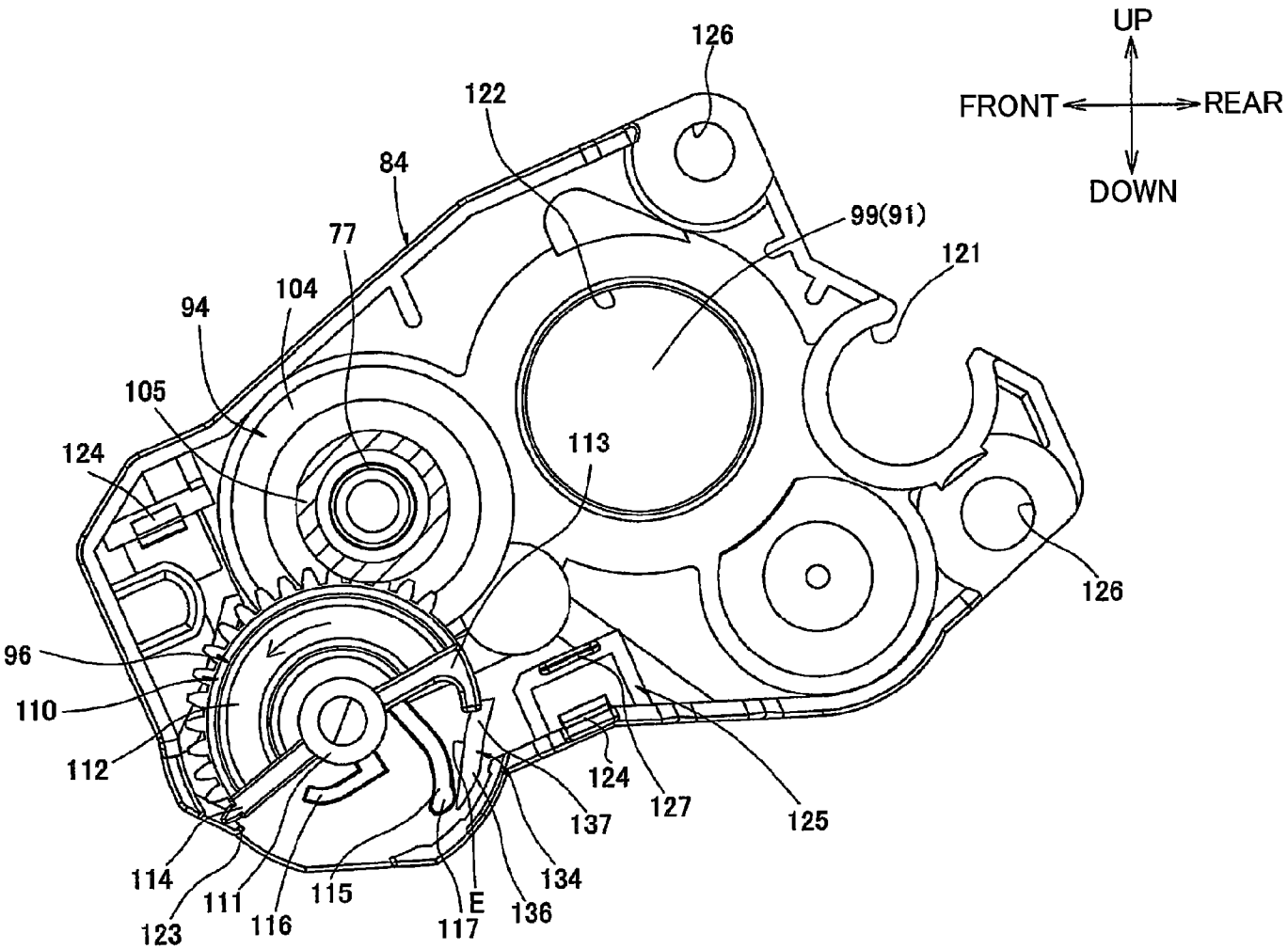
FIG. 16 is an explanatory view explaining the new product sensing operation of the developing cartridge after FIG. 15, wherein the first contact part of the detectable gear is in contact with a first sliding part of an opposing rib of the gear cover.

As shown in FIG. 16, the opposing rib 134 is disposed to the front of the agitator-gear-restricting part 125. The opposing rib 134 is a ridge that is elongated in an approximate vertical direction and that protrudes rightward from the inner surface (right surface) on the left wall of the gear cover 84. The front surface of the opposing rib 134 is an opposing surface. The opposing rib 134 is bent at a midway point in its vertical dimension (hereinafter called a bent part E). The opposing rib 134 is integrally provided with a first sliding part 136 below the bent part E, and a second sliding part 137 above the bent part E.

The first sliding part 136 extends upward while sloping toward the rear. The front surface of the first sliding part 136 is a first contact surface. The distance between the top end of the first sliding part 136 (i.e., the bent part E) and the shaft part 111 of the detectable gear 96 is shorter than the distance between the bottom end of the first sliding part 136 and the shaft part 111. In other words, the first sliding part 136 extends upward while growing closer to the shaft part 111.

The second sliding part 137 is formed continuously with the top end of the first sliding part 136 and extends upward while sloping farther rearward than the first sliding part 136. The front surface of the second sliding part 137 is a second contact surface. The distance between the top end of the second sliding part 137 and the shaft part 111 of the detectable gear 96 is longer than the distance between the bottom end of the second sliding part 137 (i.e., the bent part E) and the shaft part 111. In other words, the second sliding part 137 extends upward while going farther away from the shaft part 111.

As shown in FIG. 7, the gear cover 84 is also provided with a plurality (2 in the preferred embodiment) of anchoring pawls 124. A plurality (2 in the preferred embodiment) of screw insertion holes 126 is also formed in the gear cover 84.

The anchoring pawls 124 are provided one near an upper-front end portion and the other on a bottom end portion of the gear cover 84.

More specifically, the upper anchoring pawl 124 is provided on the inside (on the lower rear side) of the upper-front peripheral wall of the gear cover 84. The upper anchoring pawl 124 protrudes rightward from the inner surface (right surface) on the left wall of the gear cover 84. The right end of the upper anchoring pawl 124 has a hook-like shape that bends downward.

The lower anchoring pawl 124 is disposed below the agitator-gear-restricting part 125. The lower anchoring pawl 124 protrudes inward in the left-right direction (rightward) from the inner left-right edge (right edge) on the lower peripheral wall of the gear cover 84. The right end of the lower anchoring pawl 124 has a hook-like shape that bends upward.

One of the screw insertion holes 126 is formed in both upper-rear and lower-rear end portions of the gear cover 84. The screw insertion holes 126 have a general circular shape in a side view and penetrate the gear cover 84.

Figure 8:
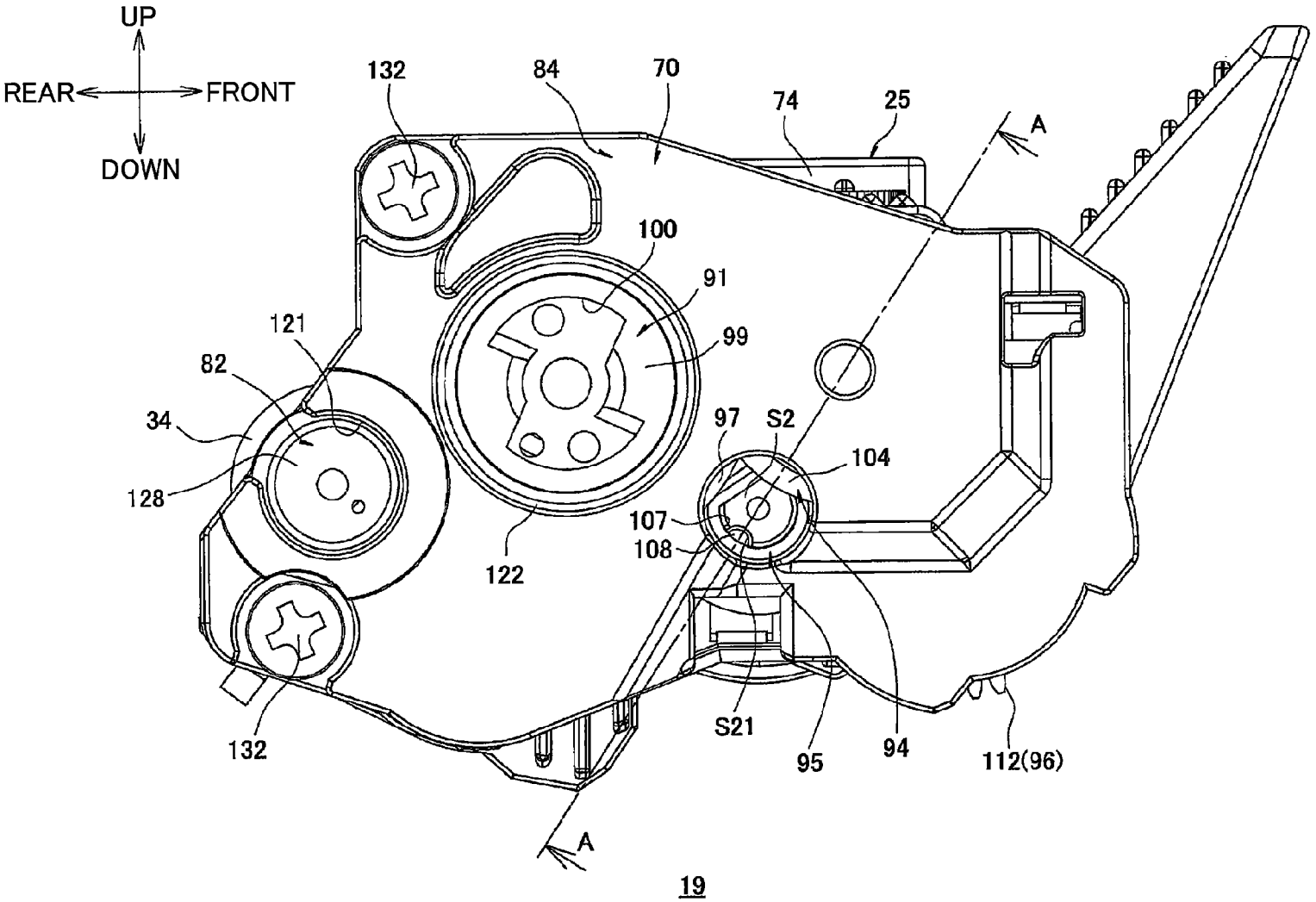
FIG. 8 is a left side view of the developing cartridge shown in FIG. 1.
Figure 9:
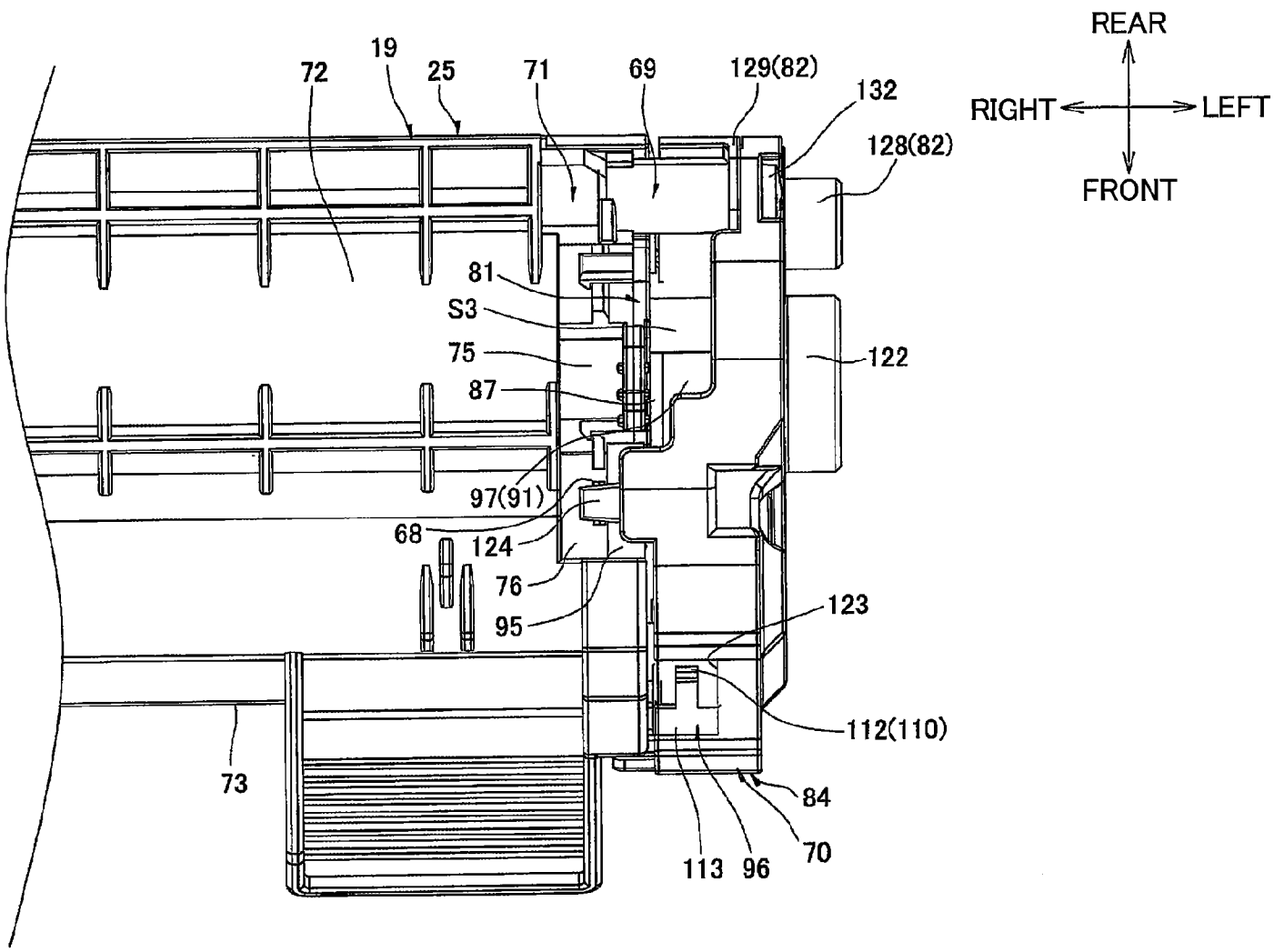
FIG. 9 is a bottom view of the developing cartridge shown in FIG. 8.

As shown in FIGS. 8 and 9, the gear cover 84 covers the gear train 83 with the collar part 128 of the collar member 82 inserted into the collar exposure opening 121 and the left end of the development coupling 91 inserted into the coupling collar 122.

In this state, the restricting protrusion 127 is disposed in confrontation with the left side of the agitator gear 95 on the lower end thereof, as shown in FIG. 10. Further, the idle-gear-supporting part 133 is inserted into the fitting hole 106 formed in the large-diameter part 104 of the idle gear 94.

Figure 12:
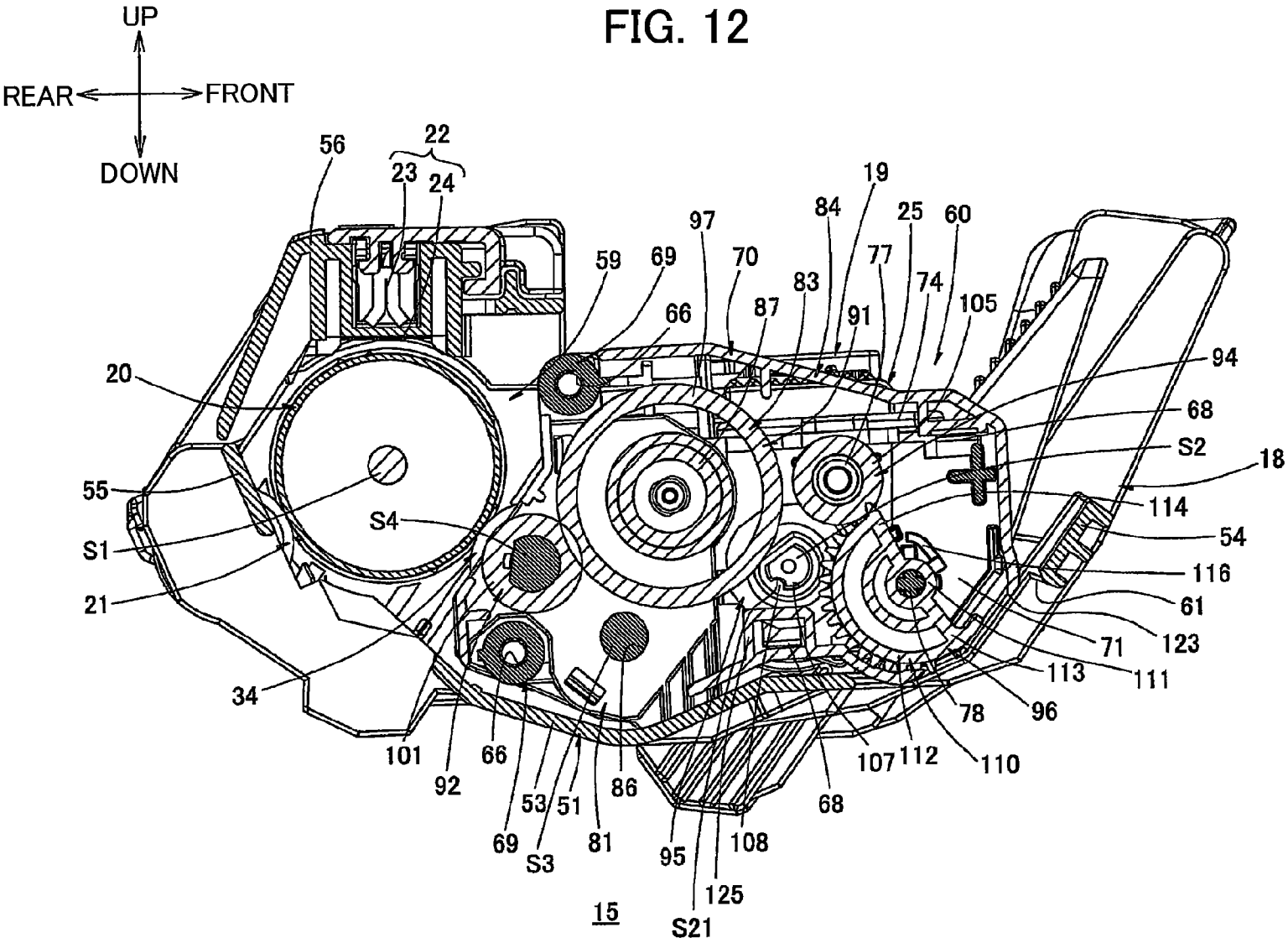
FIG. 12 is a cross-sectional view of a process cartridge shown in FIG. 1.

In addition, the upstream circumferential end portion of the detectable gear 96 in the clockwise direction in a left side view is exposed through the detectable-gear exposure opening 123 (see FIG. 12).

The front side of the gear cover 84 is anchored to the left side wall 71 of the developing-cartridge frame 25 by engaging the upper anchoring pawl 124 with the upper engageable part 68 of the developing-cartridge frame 25 and by engaging the lower anchoring pawl 124 with the lower engageable part 68 of the developing-cartridge frame 25.

The rear side of the gear cover 84 is fastened to the left side wall 71 of the developing-cartridge frame 25 by inserting a screw 132 through the upper screw insertion hole 126 formed in the gear cover 84 and the screw insertion hole 130 formed in the collar member 82 and screwing the screw 132 into the upper threaded part 69 of the developing-cartridge frame 25, and by inserting another screw 132 through the lower screw insertion hole 126 formed in the gear cover 84 and screwing the screw 132 into the lower threaded part 69 of the developing-cartridge frame 25.

(3) Drive Test for the Developing Cartridge

When the developing cartridge 19 is manufactured, a drive test is performed on the developing cartridge 19 after the gear train 83 has been assembled as described above.

In order to perform a drive test on the developing cartridge 19, a drive force is inputted into the development coupling 91 while the gear teeth on the detectable gear 96 and idle gear 94 are not engaged, as shown in FIG. 11.

More specifically, the second engaging part 116 is placed in contact with the left end of the drive-detection engageable part 79 from below so that the detectable gear 96 is arranged with the toothed part 112 beneath the shaft part 111.

Through this operation, the detectable gear 96 is disposed in a drive test position as an example of a fourth position. In the drive test position, the detectable gear 96 is restricted from rotating clockwise in a left side view while the second contact part 114 of the detectable gear 96 is below and separated from the idle gear 94.

When the drive force is subsequently inputted into the development coupling 91, the development coupling 91 transmits the drive force to the supply roller 33, developing roller 34, and agitator 29 through the gear train 83, while the detectable gear 96 does not rotate.

More specifically, the drive force inputted into the development coupling 91 is transmitted to the developing roller shaft S4 via the gear part 101 of the development gear 92 engaged with the large-diameter gear part 97 of the development coupling 91. The developing roller 34 rotates as a result.

Further, the drive force inputted into the development coupling 91 is transmitted to the supply roller shaft S3 via the supply gear 93 engaged with the small-diameter gear part 98 of the development coupling 91 and is transmitted to the idle gear 94 via the large-diameter part 104 of the idle gear 94 engaged with the small-diameter gear part 98. The supply roller 33 and idle gear 94 rotate as a result.

The drive force inputted into the idle gear 94 is also transmitted to the agitator shaft S2 via the agitator gear 95 engaged with the small-diameter part 105 of the idle gear 94. The agitator 29 is rotated as a result.

If any of the supply roller 33, developing roller 34, or agitator 29 does not rotate normally at this time or if any other abnormality is discovered in the developing cartridge 19 undergoing the drive test, the developing cartridge 19 is not shipped but is subjected to repair or is discarded.

Figure 13:
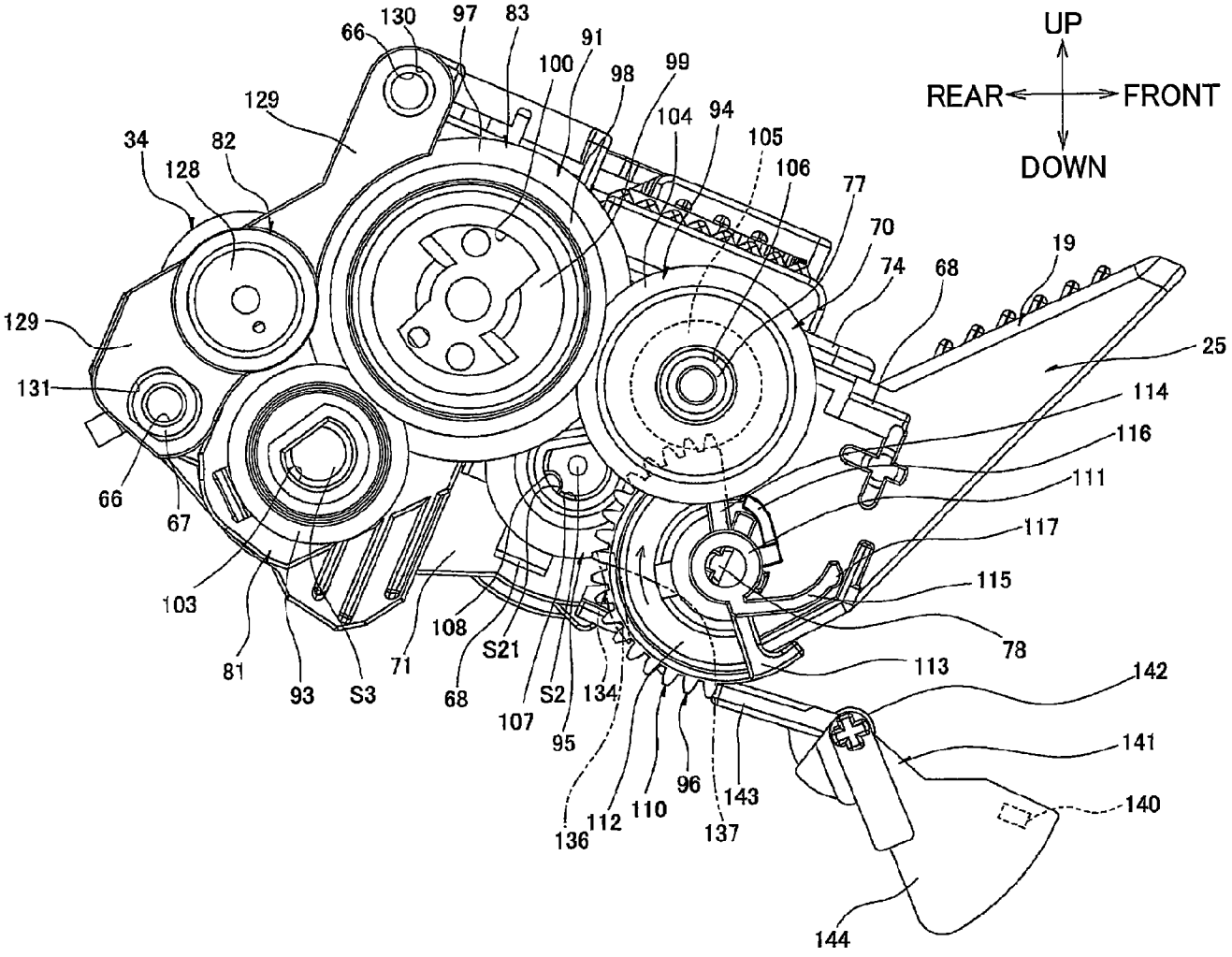
FIG. 13 is an explanatory view explaining a new product sensing operation of the developing cartridge, wherein a first contact part of the detectable gear is in abutment with an actuator to place the actuator in a detection position.
Figure 14:
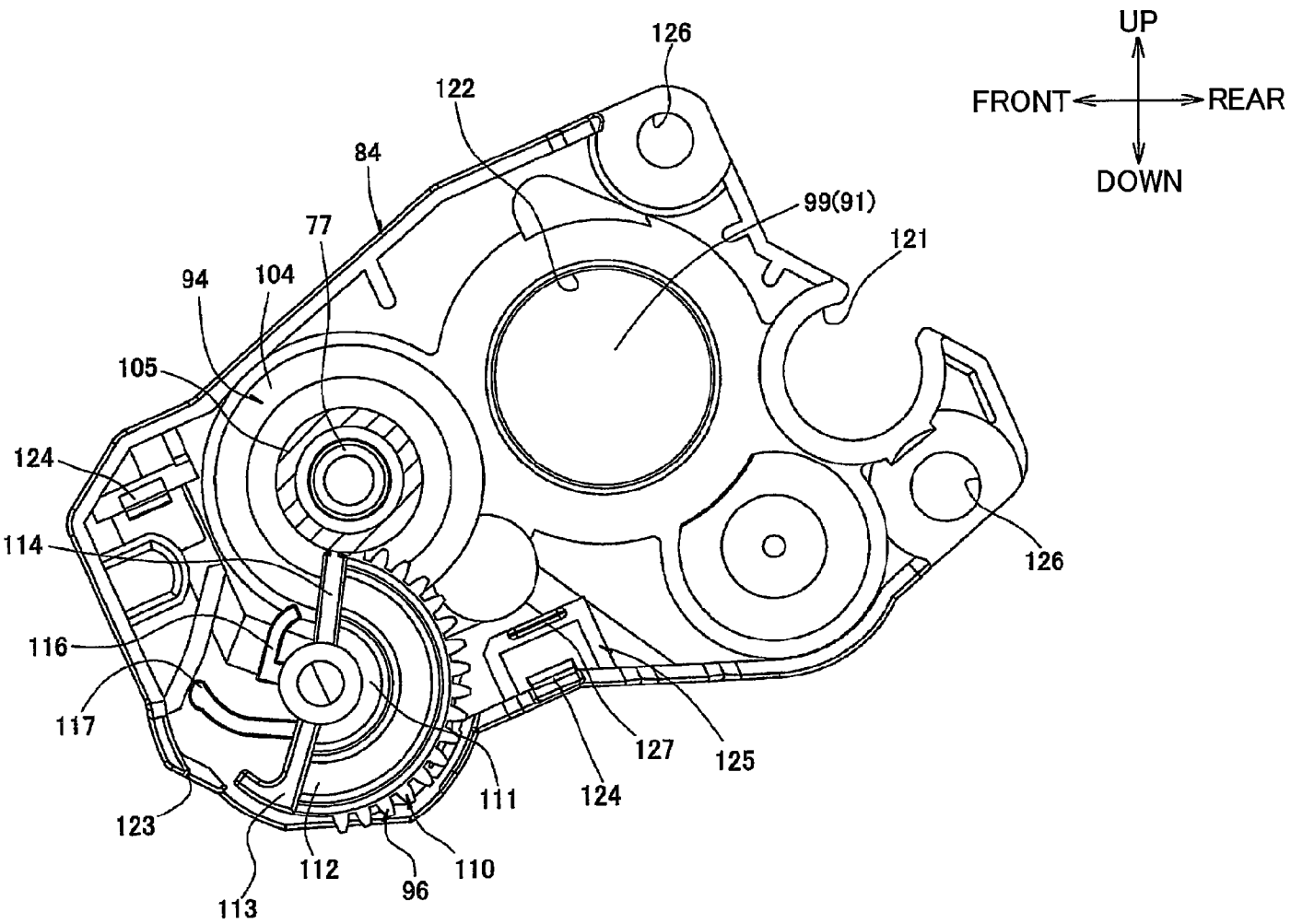
FIG. 14 is an explanatory view explaining engagement between the detectable gear and an idle gear in a state shown in FIG. 13.

If the drive test was performed on the developing cartridge 19 with no abnormalities being detected, next the detectable gear 96 is rotated clockwise in a left side view until the second engaging part 116 is positioned on the front side of the drive-detection engageable part 79 and the second contact part 114 of the detectable gear 96 is engaged with the small-diameter part 105 of the idle gear 94 from the lower front side thereof, as illustrated in FIG. 13.

More specifically, the detectable gear 96 is first rotated clockwise in a left side view from the drive test position (see FIG. 11).

In this state, the second engaging part 116 of the detectable gear 96 is forcibly bent (resiliently deformed) so that its distal end (free end) approaches the shaft part 111 while contacted from below by the drive-detection engageable part 79.

As the detectable gear 96 continues to rotate, the second engaging part 116 passes under the drive-detection engageable part 79 from the rear side toward the front side, at which time the resilient force of the second engaging part 116 restores the second engaging part 116 to its original state in front of the drive-detection engageable part 79.

At this time, the second contact part 114 of the detectable gear 96 engages with the small-diameter part 105 of the idle gear 94 from the lower front side thereof. Through this action, the detectable gear 96 is disposed in a first position and is engaged with the development coupling 91 so as to be capable of receiving the drive force transmitted from the development coupling 91.

Production of the developing cartridge 19 is subsequently completed after the collar member 82 and gear cover 84 are assembled thereon, as described above.

4. Main Casing

Figure 15:
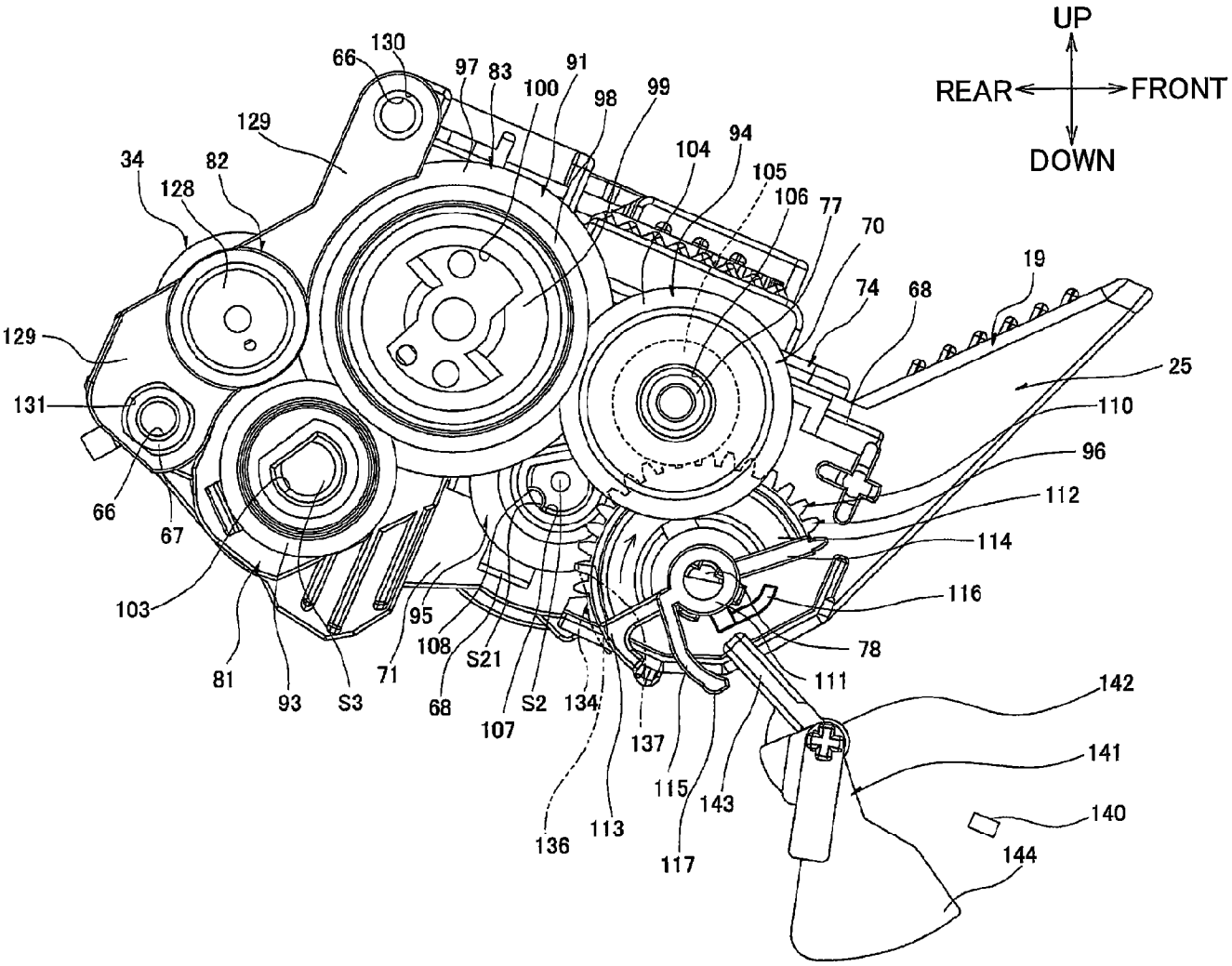
FIG. 15 is an explanatory view explaining the new product sensing operation of the developing cartridge after FIG. 13, wherein the first contact part of the detectable gear is separated rearward from the actuator to place the actuator in a non-detection position.

As shown in FIG. 15, an actuator 141 is provided in the main casing 2 as an example of a first sensor.

The actuator 141 is disposed in a left end portion of the main casing 2 and positioned diagonally upward and forward of the pickup roller 11 (see FIG. 1). The actuator 141 includes a pivot shaft 142, a sensing part 143, and an operating part 144.

The pivot shaft 142 is formed in a general columnar shape that is elongated in the left-right direction.

The sensing part 143 is formed in a rail-like shape and extends upward and rearward from an upper rear end portion of the pivot shaft 142.

The operating part 144 is formed in a plate shape having a general fan shape and extends downward from a bottom end portion of the pivot shaft 142.

The actuator 141 is pivotably movably supported in the main casing 2 at the pivot shaft 142.

With this configuration, the actuator 141 can pivot between a non-detection position (see FIG. 15) in which the sensing part 143 is erected toward the upper rear side, and a detection position (see FIG. 13) in which the sensing part 143 leans toward the rear. An urging member (not shown) constantly urges the actuator 141 toward the non-detection position.

When the actuator 141 is in the non-detection position, a sensor 140 (an optical sensor, for example) provided in the main casing 2 does not detect the operating part 144.

When the actuator 141 is in the detection position, the sensor 140 detects the operating part 144.

As indicated by phantom lines in FIG. 3, a power supply 145, an electrical-conduction sensing unit 146 serving as an example of a second sensor, and a CPU 147 are provided in the main casing 2.

The power supply 145 is electrically connected to the wire electrode 62 through the electrical-conduction sensing unit 146. The power supply 145 supplies power to the wire electrode 62.

The electrical-conduction sensing unit 146 is positioned between the power supply 145 and wire electrode 62 and is electrically connected to both the power supply 145 and wire electrode 62. The electrical-conduction sensing unit 146 detects an electric current flowing from the power supply 145 to the wire electrode 62.

The CPU 147 is electrically connected to both the sensor 140 (described above) and the electrical-conduction sensing unit 146.

As will be described later in greater detail, the CPU 147 determines whether the drum cartridge 18 is mounted in or detached from the main casing 2 based on results of the electrical-conduction sensing unit 146 detecting the electric current flowing from the power supply 145 to the wire electrode 62. The CPU 147 also determines whether the developing cartridge 19 is mounted in or removed from the main casing 2 and whether the developing cartridge 19 is new or used based on results of the sensor 140 detecting the pivoting of the actuator 141.

5. Mounting the Developing Cartridge in the Main Casing (1) Mounted State of the Developing Cartridge in the Drum Cartridge When the developing cartridge 19 is mounted in the cartridge-mounting section 60 of the drum cartridge 18 as shown in FIG. 12, the detectable gear 96 is exposed at the lower front side of the drum-cartridge frame 51 through the detectable-gear exposure opening 123 formed in the gear cover 84 and the detectable-gear exposure opening 61 formed in the drum-cartridge frame 51.

(2) Mounting the Process Cartridge in the Main Casing

To mount the process cartridge 15 in the main casing 2, first the top cover 7 of the main casing 2 is placed in the open position described above, as shown in FIG. 1.

Next, the operator grips the front end portion of the drum cartridge 18 and inserts the process cartridge 15 into the main casing 2 so that both left and right ends of the drum shaft 51 of the photosensitive drum 20 are fitted into the guide parts 37 provided in the main casing 2.

Next, the operator pushes the process cartridge 15 diagonally downward and rearward along the guide parts 37 and subsequently rotates the process cartridge 15 clockwise in a left side view about the drum shaft 51 of the photosensitive drum 20.

As the operator is rotating the process cartridge 15 in this way and just before the process cartridge 15 is completely mounted in the main casing 2, a device-side grid electrode (not shown) provided in the main casing 2 contacts the grid electrode 63 from the rear side thereof, and a device-side wire electrode (not shown) provided in the main casing 2 contacts the wire electrode 62 from below. Through this action, the device-side grid electrode (not shown) becomes electrically connected to the grid electrode 63, and the device-side wire electrode (not shown) becomes electrically connected to the wire electrode 62.

Mounting of the process cartridge 15 in the main casing 2 is complete when the drum shaft S1 of the photosensitive drum 20 is positioned in the rear ends of the guide parts 37 and the front end portion of the drum cartridge 18 is positioned lower than the irradiation path of the laser beam L so as not to interfere with the laser beam L.

At this time, the detectable gear 96 of the developing cartridge 19 is disposed at the bottom of the gear train 83, as shown in FIG. 13. The upstream circumferential end portion of the detectable gear 96 in the clockwise direction in a left side view contacts the sensing part 143 of the actuator 141 from above.

Through this contact, the actuator 141 pivots counterclockwise in a left side view against the urging force of the urging member (not shown) and is placed in the detection position.

Subsequently, the operator places the top cover 7 of the main casing 2 in the closed position.

To remove the process cartridge 15 from the main casing 2, the operations of the process cartridge 15 and main casing 2 are performed in reverse from the mounting operations described above.

Specifically, after placing the top cover 7 in the open position, the operator pulls the process cartridge 15 diagonally upward and forward.

When the operator pulls the process cartridge 15 in this way, the detectable gear 96 of the developing cartridge 19 is raised above and separated from the sensing part 143 of the actuator 141. Accordingly, the urging force of the urging member (not shown) causes the actuator 141 to pivot clockwise in a left side view and places the actuator 141 in the non-detection position (see FIG. 15).

6. New Product Sensing Operation

When the top cover 7 of the main casing 2 is placed in its closed position, the coupling protrusion 47 of the main coupling 46 provided in the main casing 2 (see FIG. 5) moves in association with the closing operation for the top cover 7 and is fitted into the development coupling 91 of the developing cartridge 19 so as to be incapable of rotating relative to the development coupling 91.

Thereafter, as illustrated by the phantom lines in FIG. 3, the power supply 145 provided in the main casing 2 supplies power to the wire electrode 62 through the device-side wire electrode (not shown). At this time, the electrical-conduction sensing unit 146 confirms that electricity is conducted to the charging wire 23.

When the electrical-conduction sensing unit 146 detects an electric current flowing from the power supply 145 to the wire electrode 62, the CPU 147 determines that the drum cartridge 18 is mounted in the main casing 2.

If the electrical-conduction sensing unit 146 does not detect the electric current flowing from the power supply 145 to the wire electrode 62 within a prescribed time after the top cover 7 has been moved to the closed position, the CPU 147 determines that the drum cartridge 18 is not mounted in the main casing 2.

Further, if the sensor 140 does not detect that the actuator 141 is in its detection position within a prescribed time after the top cover 7 has been moved to the closed position, the CPU 147 determines that the developing cartridge 19 is not mounted in the main casing 2.

Thus, if the electrical-conduction sensing unit 146 detects the electric current flowing from the power supply 145 to the wire electrode 62 and the sensor 140 detects that the actuator 141 is in its detection position before the prescribed time has elapsed, the CPU 147 determines that the process cartridge 15 (the drum cartridge 18 and developing cartridge 19) are mounted in the main casing 2. When the CPU 147 determines that the process cartridge 15 has been mounted, a drive source (not shown) provided in the main casing 2 transmits a drive force through the coupling protrusion 47 of the main coupling 46 for rotating the development coupling 91 clockwise in a left side view and for initiating a warm-up operation.

The gear train 83 then transmits this drive force to the detectable gear 96, causing the detectable gear 96 to rotate clockwise in a left side view.

Through this operation, the first contact part 113 of the detectable gear 96 moves rearward and separates from the sensing part 143 of the actuator 141, as shown in FIG. 15.

Consequently, the urging force of the urging member (not shown) causes the actuator 141 to pivot clockwise in a left side view until the actuator 141 arrives in the non-detection position.

As the detectable gear 96 rotates further counterclockwise in a right side view (i.e., clockwise in a left side view) as illustrated in FIG. 16, the sliding part 117 on the first engaging part 115 of the detectable gear 96 contacts the lower end of the first sliding part 136 constituting the opposing rib 134 from the front side thereof.

As the detectable gear 96 continues to rotate, the sliding part 117 of the first engaging part 115 slides upward along the front surface of the first sliding part 136. While the sliding part 117 is sliding, the first engaging part 115 bends resiliently (resiliently deforms) so that the sliding part 117 moves closer to the shaft part 111.

Figure 17:
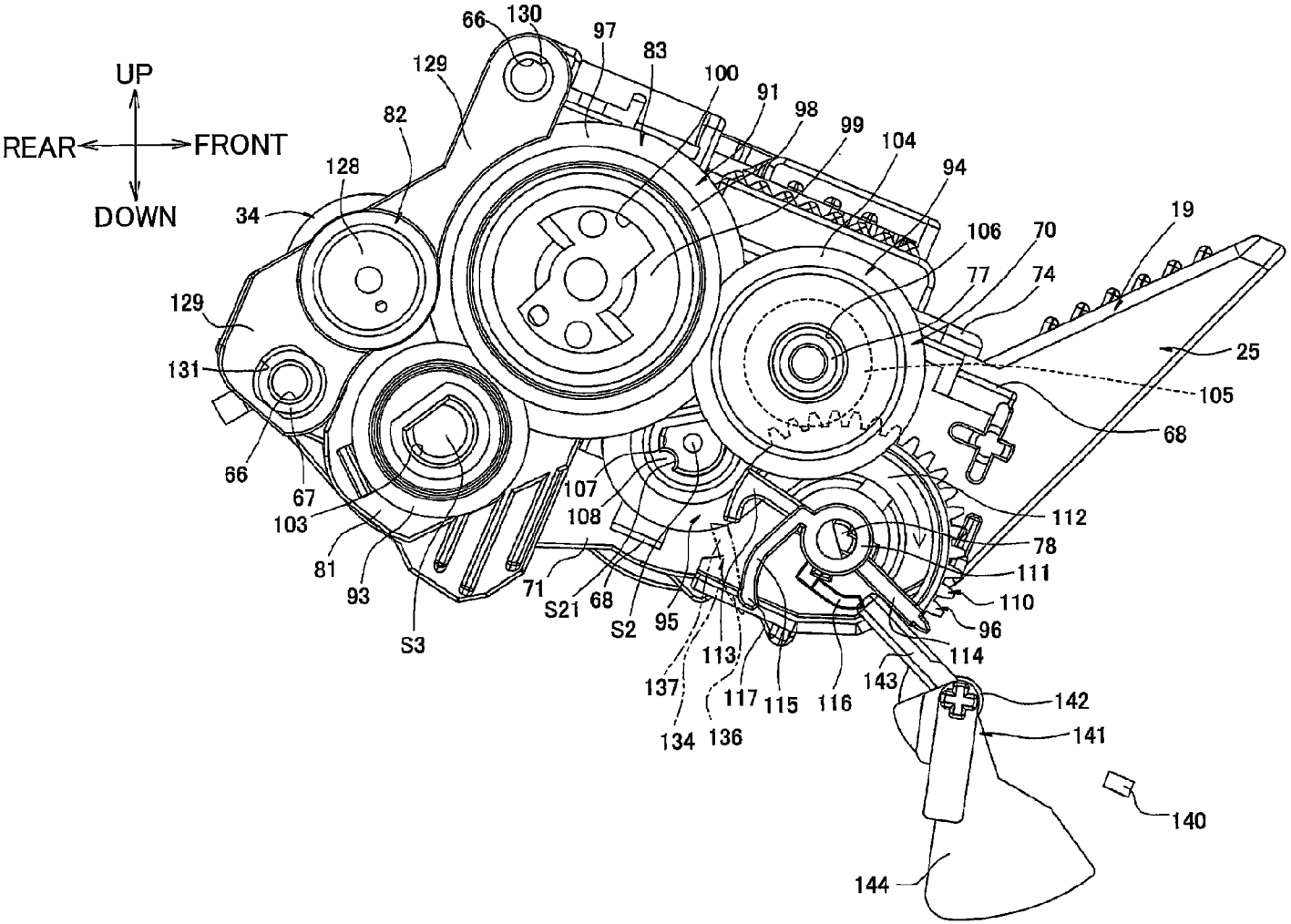
FIG. 17 is an explanatory view explaining the new product sensing operation of the developing cartridge after FIG. 16, wherein a second contact part of the detectable gear is in contact with the actuator from an upper-front side thereof.

Also at this time, the second contact part 114 contacts the sensing part 143 of the actuator 141 on the upper front side thereof, as illustrated in FIG. 17.

As the detectable gear 96 continues to rotate, the second contact part 114 of the detectable gear 96 pushes the sensing part 143 of the actuator 141 diagonally downward and rearward.

This pressure causes the actuator 141 to pivot counterclockwise in a left side view against the urging force of the urging member (not shown), moving the actuator 141 from the non-detection position to the detection position.

Figure 18:
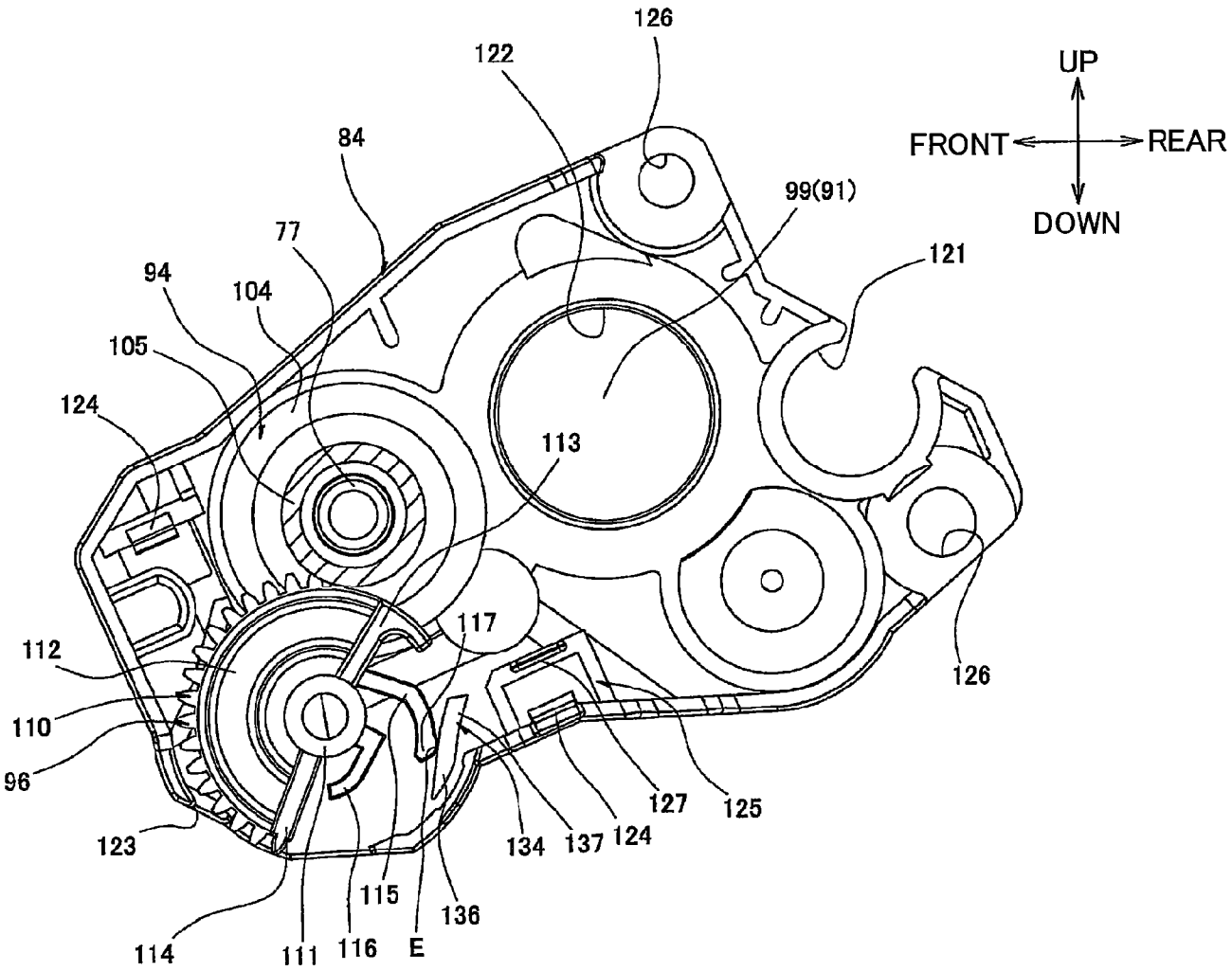
FIG. 18 is an explanatory view explaining the new product sensing operation of the developing cartridge after FIG. 17, wherein a first engaging part of the detectable gear is in contact with a bent part of the opposing rib of the gear cover.

At this time, the detectable gear 96 is disposed in a second position, as shown in FIG. 18. Further, the sliding part 117 of the first engaging part 115 confronts the bent part E of the opposing rib 134 at the top end of the first sliding part 136 with the first engaging part 115 in its resiliently deformed state.

Also at this time, the toothed part 112 of the detectable gear 96 is engaged with the small-diameter part 105 of the idle gear 94 at the upstream-most end of the toothed part 112 in its rotating direction.

As the detectable gear 96 continues to rotate, the sliding part 117 of the first engaging part 115 slides over the bent part E and onto the front surface of the second sliding part 137 at the lower end of the second sliding part 137.

Here, the resilient force of the first engaging part 115 begins restoring the first engaging part 115 to its natural shape while pressing the sliding part 117 against the front surface of the second sliding part 137.

The reaction force generated from the first engaging part 115 pressing against the second sliding part 137 causes the detectable gear 96 to rotate farther.

Figure 19:
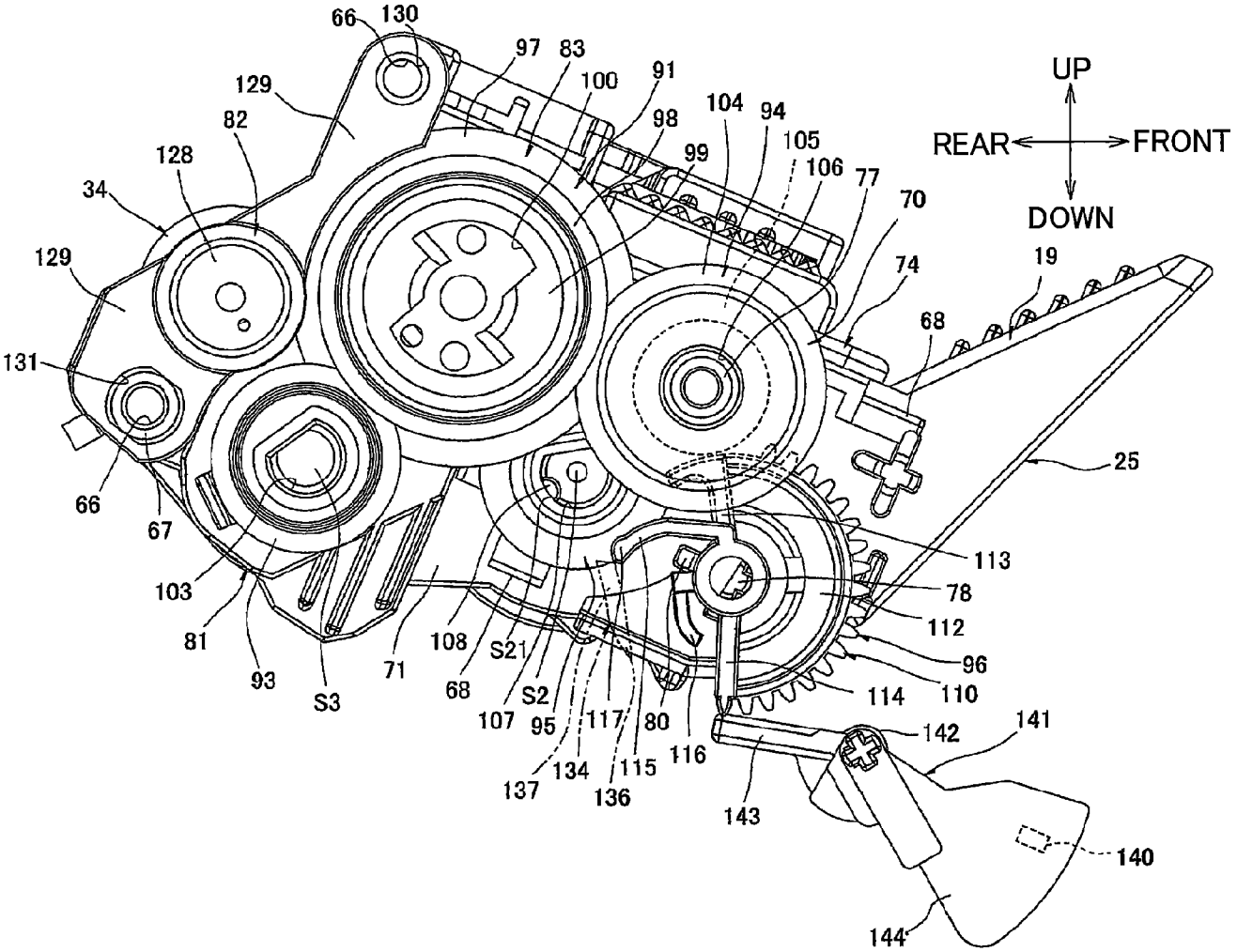
FIG. 19 is an explanatory view explaining the new product sensing operation of the developing cartridge after FIG. 18, wherein the second contact part of the detectable gear is in contact with the actuator to place the actuator in the detection position.
Figure 20:
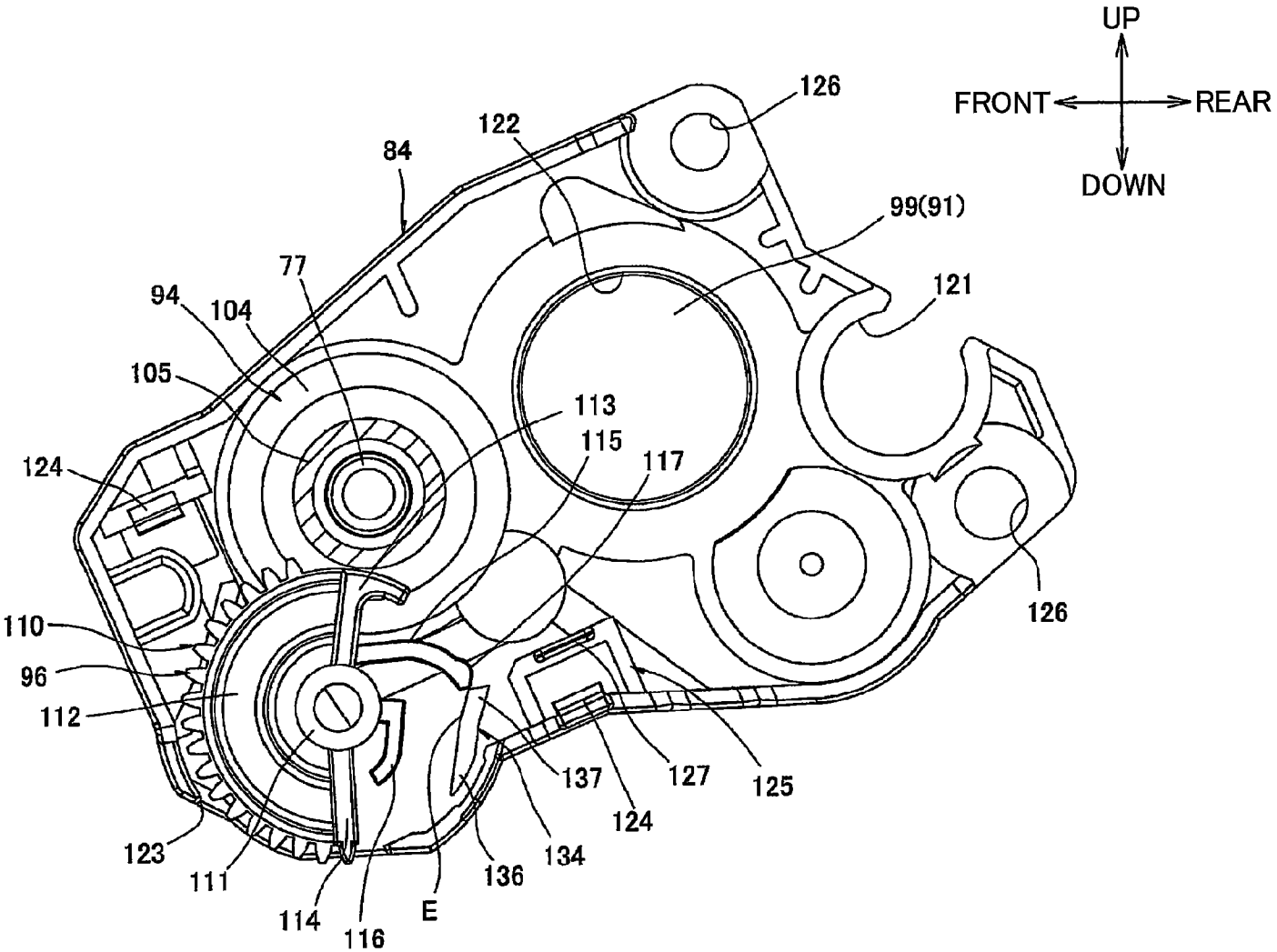
FIG. 20 is an explanatory view explaining disengagement between the detectable gear and the idle gear in a state shown in FIG. 19.

Consequently, the upstream-most end of the toothed part 112 in its rotating direction moves forward and separates from the small-diameter part 105 of the idle gear 94, as illustrated in FIGS. 19 and 20.

At this time, the second engaging part 116 comes into contact with the engageable boss 80 of the developing-cartridge frame 25 from below (see FIG. 19) and restricts the detectable gear 96 from rotating further clockwise in a left side view. In addition, the sliding part 117 of the first engaging part 115 contacts the top end of the opposing rib 134 from above (see FIG. 20), restricting the detectable gear 96 from rotating counterclockwise in a left side view (second direction).

As a result of these operations, the detectable gear 96 is disposed in its third position, in a state disengaged from the small-diameter part 105 of the idle gear 94.

In this state, the second contact part 114 of the detectable gear 96 remains in contact with the sensing part 143 of the actuator 141 from above.

When the sensor 140 detects that the actuator 141 has moved sequentially from the detection position to the non-detection position and back to the detection position, the CPU 147 in the main casing 2 determines that the developing cartridge 19 has not been used (information related to the developing cartridge 19).

When a used developing cartridge 19 is mounted in the main casing 2, the detectable gear 96 is already disposed in the third position. Accordingly, the detectable gear 96 will not rotate when the developing cartridge 19 is remounted, and the second contact part 114 of the detectable gear 96 will remain in contact with the sensing part 143 of the actuator 141 from above.

Consequently, the actuator 141 will remain disposed in the detection position.

When the sensor 140 detects that the actuator 141 has remained in the detection position for a prescribed time, the CPU 147 in the main casing 2 determines that the developing cartridge 19 mounted in the main casing 2 is used (information related to the developing cartridge 19).

7. Operational Advantages (1) In the developing cartridge 19 described above, the second contact part 114 of the detectable gear 96 is disposed at the same left-right position as the toothed part 112, as shown in FIG. 4. Together with the toothed part 112, the second contact part 114 constitutes the passive part 110.

Hence, the second contact part 114 and toothed part 112 can be arranged efficiently with respect to the left-right direction.

As a result, the developing cartridge 19 itself can be made more compact in the left-right direction.

(2) Further, when the detectable gear 96 rotates from the first position shown in FIG. 13 to the second position shown in FIG. 17, the second contact part 114 receives the drive force from the small-diameter part 105 of the idle gear 94 and is moved to contact the actuator 141.

Thus, this configuration prevents the actuator 141 from contacting and damaging the second contact part 114 prior to receiving the drive force from the idle gear 94.

As a result, the drive force transmitted from the idle gear 94 can be reliably received at the second contact part 114 and, after receiving the drive force, the second contact part 114 can be used to determine whether the developing cartridge 19 is new or used.

(3) As shown in FIG. 4, the first contact part 113 is disposed at the same left-right position as the toothed part 112.

Therefore, the first contact part 113 and passive part 110 (toothed part 112 and second contact part 114) can be efficiently arranged in the left-right direction.

As a result, the developing cartridge 19 can be made more compact in the left-right direction, even when the detectable gear 96 is provided with the first contact part 113, which is separate from the second contact part 114.

(4) Through the engagement of the first engaging part 115 and opposing rib 134 as shown in FIG. 20, the detectable gear 96 can be held in the third position in which the small-diameter part 105 of the idle gear 94 is separated (disengaged from) the passive part 110.

Accordingly, the detectable gear 96 can be driven a prescribed amount until arriving at the third position.

Further, after the detectable gear 96 arrives in the third position, this configuration reliably cancels the drive transmission from the small-diameter part 105 of the idle gear 94 to the detectable gear 96.

(5) As shown in FIG. 18, the first engaging part 115 resiliently deforms when the drive force is transmitted from the small-diameter part 105 of the idle gear 94 to the passive part 110, and is subsequently restored to its original state shown in FIG. 20 when the drive transmission from the small-diameter part 105 to the passive part 110 is cancelled.

In other words, the drive force from the idle gear 94 is used to resiliently deform the first engaging part 115, and subsequently the restoring force of the resiliently deformed first engaging part 115 can be used to cancel the drive transmission from the idle gear 94 to the passive part 110.

As a result, the drive transmission between the idle gear 94 and detectable gear 96 can be more reliably cancelled through a simple construction of forming the first engaging part 115 to be resiliently deformable.

(6) As shown in FIG. 18, the drive force from the idle gear 94 can be used to resiliently deform the first engaging part 115 along the sloped front surface of the first sliding part 136.

Further, by restoring the resiliently deformed first engaging part 115 along the sloped front surface of the second sliding part 137, as shown in FIG. 20, the pressure applied by the first engaging part 115 to the front surface of the second sliding part 137 can cancel the drive transmission from the idle gear 94 to the passive part 110.

Hence, through a simple construction it is possible to reliably cancel the drive transmission between the idle gear 94 and detectable gear 96.

(7) As shown in FIG. 11, the detectable gear 96 can be held in the drive test position before the second contact part 114 engages with the small-diameter part 105 of the idle gear 94 through the contact between the second engaging part 116 of the detectable gear 96 and the drive-detection engageable part 79.

Accordingly, the drive force transmitted from the drive source (not shown) in the main casing 2 to the idle gear 94 can be used to implement the drive test on the developing cartridge 19 prior to the second contact part 114 engaging with the small-diameter part 105 of the idle gear 94.

As a result, the developing cartridge 19 can be reliably driven after the second contact part 114 becomes engaged with the small-diameter part 105 of the idle gear 94.

(8) According to the printer 1 described above, a drive force is inputted into the developing cartridge 19 after the printer 1 determines that the drum cartridge 18 is mounted in the main casing 2.

Accordingly, when the developing cartridge 19 is not mounted in the drum cartridge 18 and is mistakenly mounted in the main casing 2 by itself, the printer 1 can detect that the drum cartridge 18 has not been mounted prior to inputting the drive force into the developing cartridge 19.

As a result, the printer 1 can prevent the drive force being inputted into a developing cartridge 19 that was incorrectly mounted in the main casing 2, thereby preventing damage to the developing cartridge 19 and the main casing 2 attributed to incorrect mounting of the developing cartridge 19.

8. Second Embodiment

A developing cartridge 19 according to a second embodiment of the present invention will now be described with reference to FIGS. 21-24, wherein like parts and components are designated with the same reference numerals as those of the first embodiment and explanations therefor are omitted.

Figure 21:
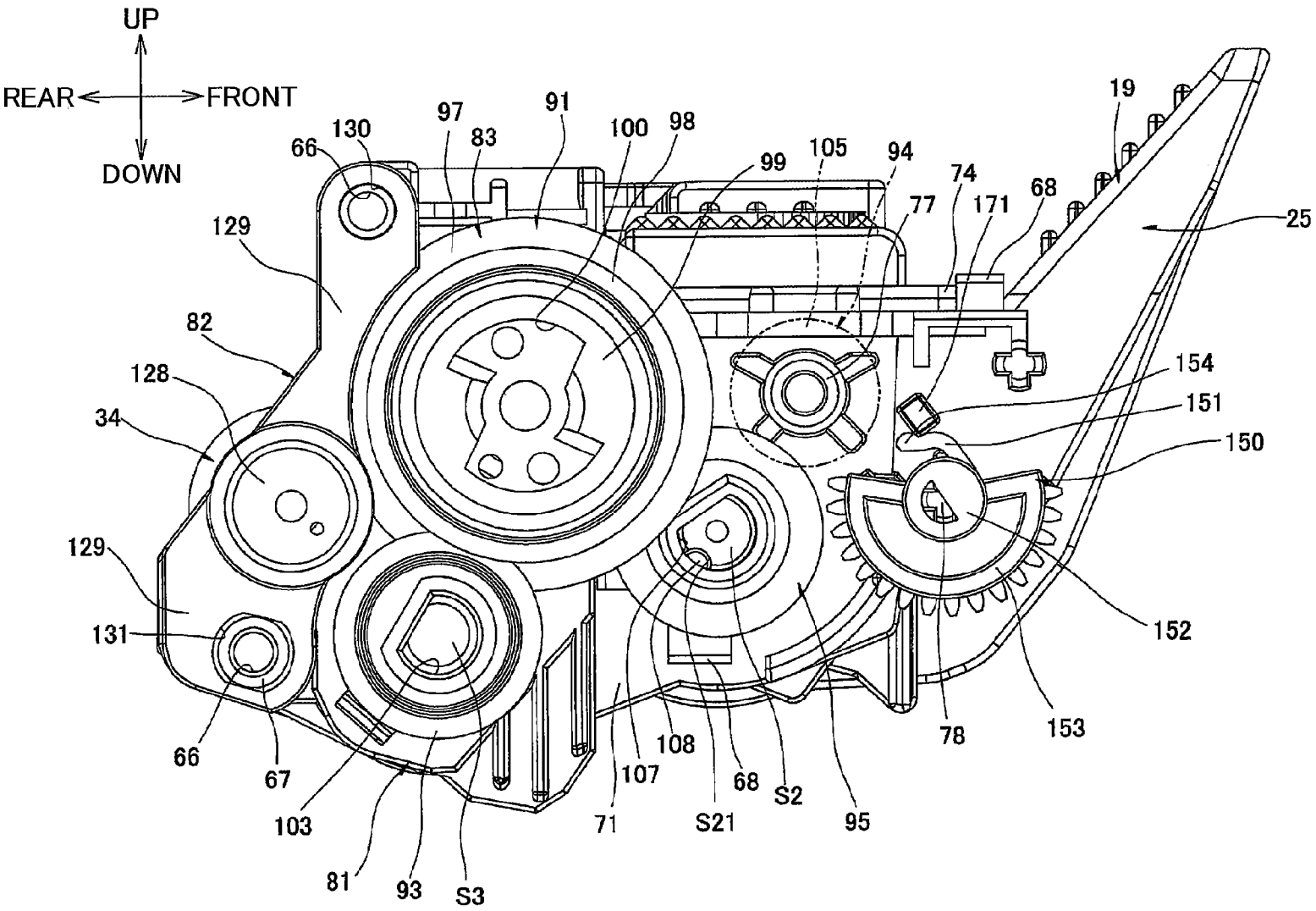
FIG. 21 is an explanatory view explaining arrangement of a detectable gear when a drive test is executed for a developing cartridge according to a second embodiment of the present invention.
Figure 22:
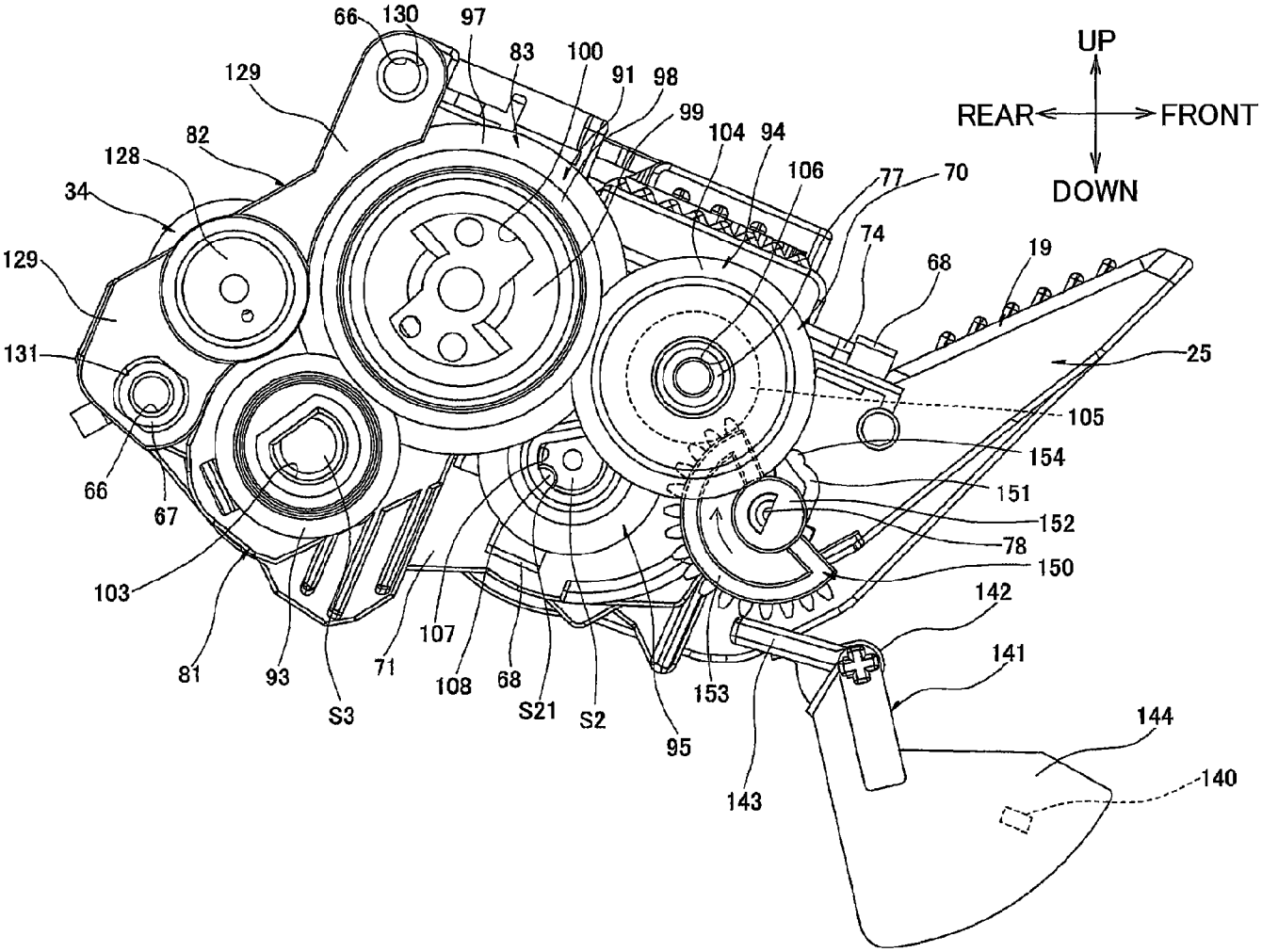
FIG. 22 is an explanatory view explaining a new product sensing operation of the developing cartridge according to the second embodiment, wherein a first contact part of the detectable gear is in abutment with the actuator to place the actuator in the detection position.
Figure 23:
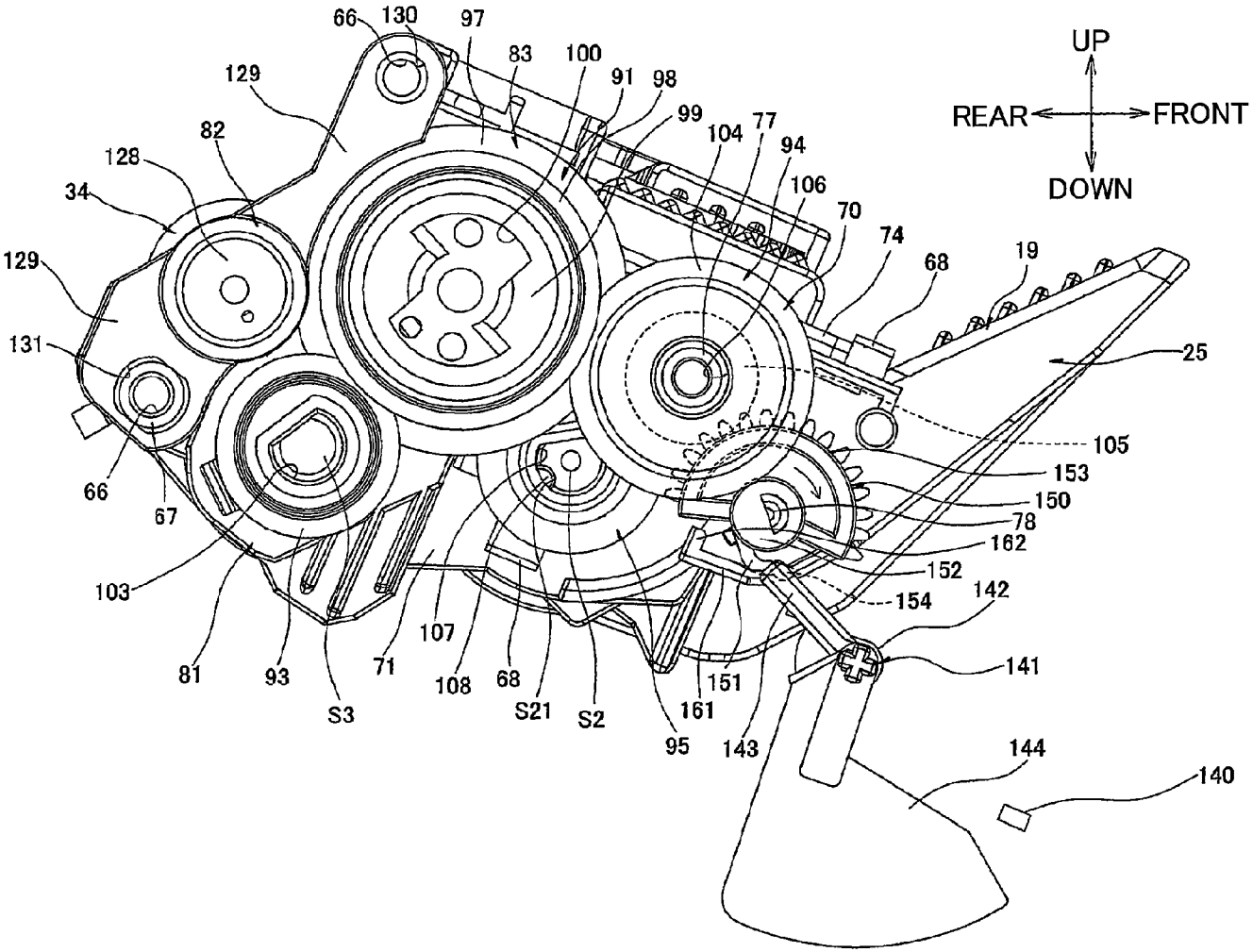
FIG. 23 is an explanatory view explaining the new product sensing operation of the developing cartridge according to the second embodiment after FIG. 22, wherein the first contact part of the detectable gear is separated rearward from the actuator to place the actuator in the non-detection position.
Figure 24:
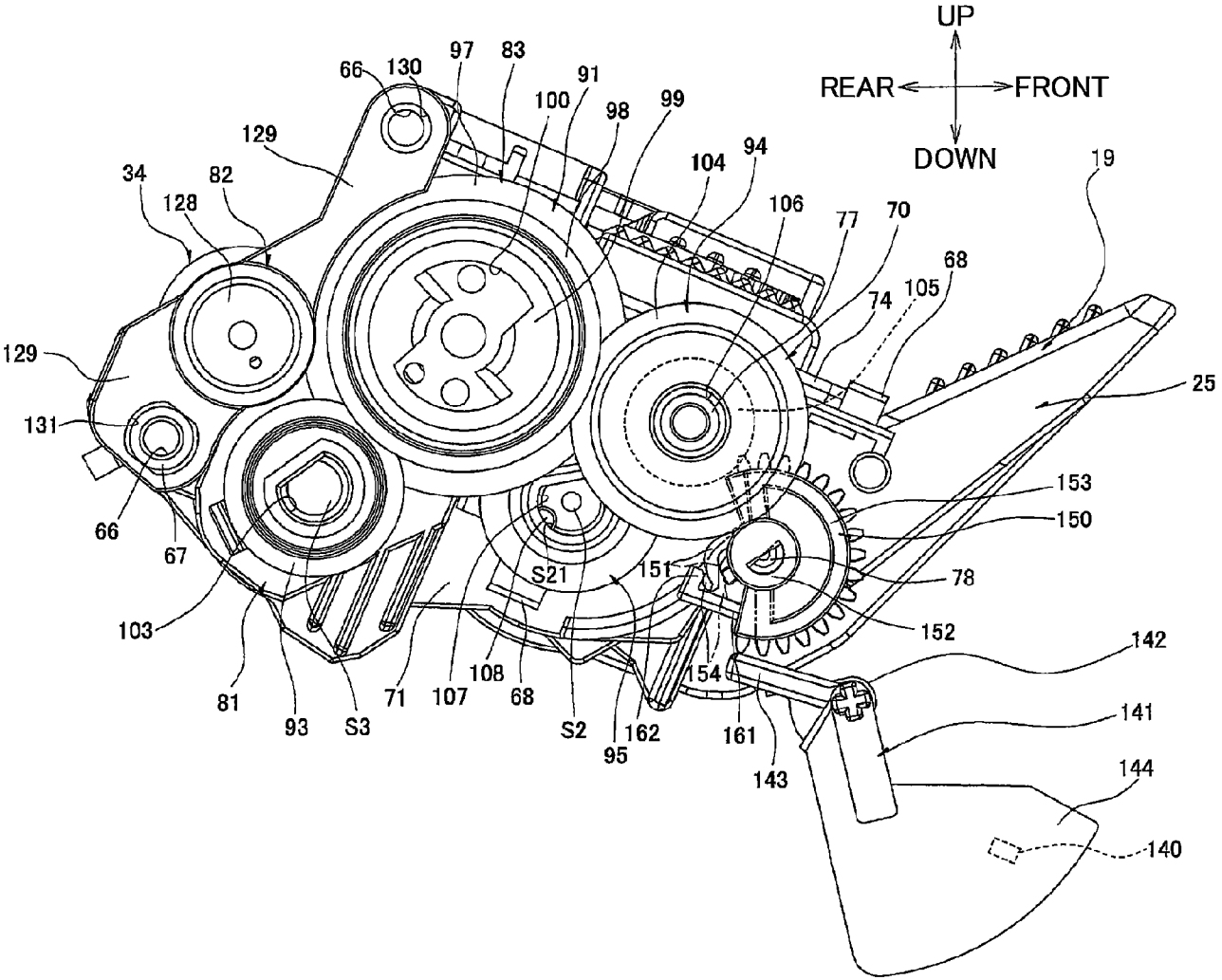
FIG. 24 is an explanatory view explaining the new product sensing operation of the developing cartridge according to the second embodiment after FIG. 23, wherein a second contact part of the detectable gear is in contact with the actuator to place the actuator in the detection position.

Arrows in FIG. 21 indicate directions when the developing cartridge 19 according to the second embodiment is resting on a level surface, while arrows in FIGS. 22 through 24 indicate directions when the developing cartridge 19 according to the second embodiment is mounted in the main casing 2.

(1) Structure of the Developing Cartridge

In the first embodiment described above, the first engaging part 115 and second engaging part 116 are provided on the detectable gear 96. During the drive test on the developing cartridge 19, the detectable gear 96 is maintained in the drive test position by the second engaging part 116 engaged with the drive-detection engageable part 79. After the new product sensing operation is completed on the developing cartridge 19, the detectable gear 96 is restricted from rotating in reverse from the third position (rotating counterclockwise in a left side view) by the first engaging part 115 engaged with the opposing rib 134.

In the second embodiment, a detectable gear 150 is provided with an engaging part 151 as an example of the first engaging part, as shown in FIGS. 21 and 23. Further, an opposing rib 161 (see FIG. 23) is provided on the side wall 71 of the developing-cartridge frame 25 as an example of the first engaged part.

More specifically, the detectable gear 150 is formed in a plate shape having a substantial thickness in the left-right direction and has a general fan shape in a side view. The detectable gear 150 includes a shaft part 152, a toothed part 153 as an example of the receiving part, and the engaging part 151.

The shaft part 152 is disposed in a radial center of the detectable gear 150. The shaft part 152 is formed in a general cylindrical shape that is elongated in the left-right direction. The shaft part 152 has an inner diameter larger than (approximately equal to) the outer diameter of the detectable-gear support part 78.

The toothed part 153 forms an external shape of the detectable gear 150. The toothed part 153 is formed in a plate shape having a substantial thickness in the left-right direction and is formed in a general fan shape in a side view, with a center angle of approximately 200°. The left-right dimension of the toothed part 153 is shorter than the left-right dimension of the shaft part 152. Gear teeth extending in the left-right direction are formed on a circumferential surface of the toothed part 153. The downstream end of the toothed part 153 in the clockwise direction in a left side view is an example of the first detected part, and the upstream end of the toothed part 153 in the clockwise direction is an example of the second detected part.

The engaging part 151 has a general rail shape that protrudes radially outward from a right end portion of the shaft part 152 while bending. More specifically, the engaging part 151 is provided on a side opposite to the toothed part 153 with respect to the shaft part 152. The engaging part 151 first protrudes radially outward from the right end portion of the shaft part 152 a slight amount, then bends and extends linearly upstream in the clockwise direction in a left side view. Near its distal end (free end), the engaging part 151 bends further upstream in the clockwise direction. A sliding part 154 is provided on the distal end of the engaging part 151 as an example of the contact end.

The sliding part 154 is formed on the distal end of the engaging part 151 with a general arc shape in a side view. The convex side of the arc shape protrudes radially outward.

On the left side wall 71, the developing-cartridge frame 25 is further provided with the opposing rib 161 (see FIG. 23), and a drive-test engageable part 171 (see FIG. 21) as an example of the second engaged part.

As shown in FIG. 23, the opposing rib 161 is formed below the detectable gear 150 as a ridge that extends in the front-rear direction and protrudes leftward from the left surface of the side wall 71. The top surface of the opposing rib 161 constitutes the opposing surface.

Further, the distance between the front-rear center of the opposing rib 161 and the shaft part 152 of the detectable gear 150 is shorter than the distance between the front end of the opposing rib 161 and the shaft part 152 of the detectable gear 150. In other words, the front half of the opposing rib 161 extends in a direction so as to grow closer to the shaft part 152 of the detectable gear 150 toward the rear. The top surface on the front half of the opposing rib 161 is the first contact surface.

Further, the distance between the front-rear center of the opposing rib 161 and the shaft part 152 of the detectable gear 150 is shorter than the distance between the rear end of the opposing rib 161 and the shaft part 152 of the detectable gear 150. In other words, the rear half of the opposing rib 161 extends in a direction so as to go away from the shaft part 152 of the detectable gear 150 toward the rear. The top surface on the rear half of the opposing rib 161 is the second contact surface.

An engageable part 162 is also provided on the rear end of the opposing rib 161.

The engageable part 162 is formed in a plate shape that is substantially rectangular in a side view and protrudes upward from the rear end of the opposing rib 161.

As shown in FIG. 21, the drive-test engageable part 171 is disposed frontward of the idle-gear support part 77 and above the detectable-gear support part 78. The drive-test engageable part 171 is formed in a general square columnar shape that protrudes leftward from the left surface of the side wall 71.

(2) Drive Test for the Developing Cartridge

When performing a drive test on the developing cartridge 19 according to the second embodiment, the detectable gear 150 is arranged such that the toothed part 153 is below the shaft part 152 and the engaging part 151 is in contact with the drive-test engageable part 171 from below, as shown in FIG. 21. At this time, the detectable gear 150 is in its drive test position (fourth position), and the toothed part 153 is below and separated from the idle gear 94.

Next, a drive force is inputted into the development coupling 91, driving the supply roller 33, developing roller 34, and agitator 29 to rotate, while the detectable gear 150 remains still.

If the supply roller 33, developing roller 34, or agitator 29 does not rotate properly at this time or if any other abnormality is detected in the developing cartridge 19 during the drive test, the developing cartridge 19 is not shipped but is either repaired or discarded.

However, if the drive test is completed on the developing cartridge 19 without detecting any abnormalities, as in the first embodiment described above, the detectable gear 150 is rotated clockwise in a left side view to place the engaging part 151 on the front side of the drive-test engageable part 171 and the downstream end of the toothed part 153 in the clockwise direction in a left side view is engaged with the small-diameter part 105 of the idle gear 94 on the lower front side thereof, as illustrated in FIG. 22.

(3) New Product Sensing Operation

When the process cartridge 15 is mounted in the main casing 2 and the top cover 7 of the main casing 2 is placed in the closed position, the coupling protrusion 47 of the main coupling 46 (see FIG. 5) provided in the main casing 2 moves in association with the operation for closing the top cover 7 and is fitted into the development coupling 91 of the developing cartridge 19 so as to be incapable of rotating relative thereto.

If the sensor 140 detects that the actuator 141 is disposed in the detection position before the prescribed time elapses, as shown in FIG. 22, the drive source (not shown) provided in the main casing 2 transmits a drive force through the coupling protrusion 47 of the main coupling 46 for rotating the development coupling 91 clockwise in a left side view to initiate a warm-up operation.

This drive force is further transmitted to the detectable gear 150 via the gear train 83, causing the detectable gear 150 to rotate clockwise in a left side view.

As a result of this rotation, the upstream end of the toothed part 153 in the clockwise direction in a left side view moves rearward and separates from the sensing part 143 of the actuator 141, as illustrated in FIG. 23.

When the toothed part 153 separates from the sensing part 143, the actuator 141 is pivoted clockwise in a left side view by the urging force of the urging member (not shown) until arriving in the non-detection position.

As the detectable gear 150 continues to rotate, the sliding part 154 on the engaging part 151 slides rearward over the top surface on the front half of the opposing rib 161. While the sliding part 154 slides over the front half of the opposing rib 161, the engaging part 151 bends resiliently (resiliently deforms) such that the sliding part 154 moves closer to the shaft part 152.

As the detectable gear 150 rotates further, the detectable gear 150 pushes the sensing part 143 of the actuator 141 diagonally downward and rearward at the downstream end of the toothed part 153 in the clockwise direction in a left side view, as illustrated by phantom lines in FIG. 24.

As a result, the actuator 141 pivots counterclockwise in a left side view against the urging force of the urging member (not shown), moving from the non-detection position to the detection position.

At this time, the detectable gear 150 is disposed in the second position, and the sliding part 154 on the engaging part 151 confronts the top surface on the rear half of the opposing rib 161.

Further, the detectable gear 150 is engaged with the small-diameter part 105 of the idle gear 94 at the upstream-most end of the toothed part 153 in its rotating direction.

Here, the resilient force (restoring force) of the engaging part 151 begins to restore the engaging part 151 to its original state, causing the engaging part 151 to press against the top surface on the rear half of the opposing rib 161. The reaction force from the rear half of the opposing rib 161 causes the detectable gear 150 to rotate further.

As a result, the upstream-most end of the toothed part 153 in its rotating direction moves forward and separates from the small-diameter part 105 of the idle gear 94.

As shown in FIG. 24, the detectable gear 150 at this time is restricted from rotating further clockwise in a left side view because the engaging part 151 contacts the engageable part 162 on the front side thereof, and is restricted from rotating counterclockwise in a left side view (the second direction) because the distal end of the engaging part 151 contacts the top surface on the rear portion of the opposing rib 161 from above.

Through this operation, the detectable gear 150 is disposed in the third position and is disengaged from the small-diameter part 105 of the idle gear 94.

Further, at this time, the downstream end of the toothed part 153 in the clockwise direction in a left side view continues to contact the sensing part 143 of the actuator 141 from above.

When the sensor 140 detects that the actuator 141 has moved in sequence from the detection position to the non-detection position and back to the detection position, the CPU 147 in the main casing 2 determines that the mounted developing cartridge 19 is not used (information related to the developing cartridge 19).

Further, when a used developing cartridge 19 is mounted in the main casing 2, the detectable gear 150 is already in the third position. Accordingly, the detectable gear 150 does not rotate when the developing cartridge 19 is mounted and the downstream end of the toothed part 153 in the clockwise direction in a left side view continues to contact the sensing part 143 of the actuator 141 from above.

Consequently, the actuator 141 remains in the detection position.

Thus, since the sensor 140 detects that the actuator 141 has remained in the detection position for the prescribed time, the CPU 147 in the main casing 2 determines that the developing cartridge 19 is used (information related to the developing cartridge 19).

(4) Operational Advantages

In the second embodiment described above, the engaging part 151 maintains the detectable gear 150 in either the third position or the fourth position, as illustrated in FIG. 24.

Accordingly, the engaging part 151 can simplify the structure of the developing cartridge 19.

The second embodiment can also obtain the same operational advantages described above for the first embodiment.

9. Variations of the Embodiments (1) In the first embodiment described above, gear teeth are formed on the toothed part 112 and second contact part 114 of the detectable gear 96. However, in place of the gear teeth, a resistance-applying member formed of a rubber or other material having a relatively high coefficient of friction may be provided on at least the outer circumferential surfaces of the toothed part 112 and second contact part 114.

In this case, a resistance-applying member formed of a rubber or other material having a relatively high coefficient of friction is also provided on at least the outer circumferential surfaces of the small-diameter part 105 of the idle gear 94 and the agitator gear 95 in place of the gear teeth.

Thus, the resistance generated between the opposing resistance-applying members transmits a drive force from the idle gear 94 to the detectable gear 96 and agitator gear 95.

This variation can also obtain the same operational advantages described above for the first embodiment.

(2) In the first embodiment described above, an optical sensor or other non-contact sensor is used to detect the pivoting motion of the actuator 141. However, a mechanical switch or another contact sensor may be used for detecting this motion.

(3) Further, the printer 1 described above is an example of the image forming device of the present invention, but the present invention is not limited to the embodiments described above.

The image forming device of the present invention may include a monochromic printer and a color printer.

Examples of color printers include: a direct tandem color printer provided with a plurality of photosensitive members, and a recording medium conveying member; and an intermediate-transfer-type tandem color printer provided with a plurality of photosensitive members, an intermediate transfer body, and a transfer member.

The cartridge that is mounted in the image forming device of the present invention includes the process cartridge 15, drum cartridge 18, and developing cartridge 19 described above.

In addition to the separable process cartridge 15 that allows the drum cartridge 18 and developing cartridge 19 to be detached from each other as described above, the process cartridge 15 may be an integrated unit in which the drum cartridge 18 and developing cartridge 19 are integrally provided.

It is also possible to provide the photosensitive member in the main casing 2 serving as an example of the main body, while enabling only the developing cartridge 19 to be mounted in and removed from the main casing 2.

The developing cartridge 19 may also be configured of an enclosure possessing the developer carrier, and a toner cartridge for accommodating toner that is detachably mountable on the enclosure.

Further, while the photosensitive drum 20 described above is an example of the photosensitive member or an image carrier, a photosensitive belt may be used as the photosensitive member or image carrier.

Further, while the developing roller 34 described above is an example of the developer carrier, a developing sleeve, developing belt, brush roller, or other device may be used as the developer carrier.

Further, while the supply roller 33 described above is an example of the supply member, a device other than the supply roller 33, such as a supply sleeve, a supply belt, or a brush roller, may be used as the supply member.

Further, while the agitator 29 described above is an example of the conveying member, a device other than the agitator 29, such as an auger screw or a conveying belt, may be used as the conveying member.

Further, while the transfer roller 21 described above is an example of the transfer member, the transfer member may be configured of a contact-type transfer member, including the transfer roller 21, a transfer belt, a transfer brush, a transfer blade, and a film-like transfer device, or a non-contact-type transfer member, including a corotron-type transfer member.

Further, while the scorotron charger 22 described above is an example of the charger, the charger may be configured of a non-contact type device, including the scorotron charger 22, a corotron-type charger, and a charger provided with a sawtooth discharge member, or a contact-type charger such as a charging roller.

Further, while the scanning unit 16 described above is an example of the exposing member, a device other than the scanning unit 16, such as an LED unit may be used as the exposing member.

Further, the image forming device of the present invention may be configured as a multifunction device provided with an image scanner.

While the invention has been described in detail with reference to the embodiments thereof, it would be apparent to those skilled in the art that various changes and modifications may be made therein without departing from the scope of the invention.

What is claimed is:

1. A cartridge configured to accommodate developer, comprising:

a detected member configured to rotate in a first direction about a first rotational axis extending in an axial direction, the detected member being configured to be detected by an external first sensor, the detected member including a receiving part and a first detected part; and a drive-force transmission member configured to transmit a drive force to the detected member upon receipt of an external drive force, the drive-force transmission member having a peripheral surface formed with gear teeth, the receiving part of the detected member being configured to engage the gear teeth of the drive-force transmission member to receive the drive force therefrom, a portion of the first detected part and a portion of the receiving part being arranged at the same position as each other in the axial direction, wherein the detected member is configured to rotate from a first position to a second position, the first detected part at the first position being capable of receiving the drive force from the drive-force transmission member, the first detected part at the second position being incapable of receiving the drive force from the drive-force transmission member, the first detected part at the second position being contacted by the first sensor.

2. The cartridge as claimed in claim 1, wherein the first detected part constitutes a part of the receiving part.

3. The cartridge as claimed in claim 1, wherein the detected member further includes a second detected part provided upstream of the first detected part in the first direction, and wherein a portion of the second detected part and a portion of the receiving part are arranged at the same position as each other in the axial direction.

4. The cartridge as claimed in claim 1, further comprising:

a casing configured to accommodate the developer; and a cover member configured to cover the detected member, wherein:

the detected member further includes a first engaging part;

the detected member is configured to rotate to a second position after the first detected part is detected by the first sensor, the receiving part being separated from the drive-force transmission member at the second position; and one of the casing and the cover member is provided with a first engaged part engageable with the first engaging part of the detected member at the second position, the first engaged part engaging the first engaging part restricting the detected member from rotating in a second direction opposite to the first direction.

5. The cartridge as claimed in claim 4, wherein the first engaging part is configured to resiliently deform while the drive force is transmitted from the drive-force transmission member to the receiving part, the first engaging part being configured to restore its original shape when the drive force transmission from the drive-force transmission member to the receiving part is cancelled, and wherein the restoration of the first engaging part causes the detected member to rotate to the second position.

6. The cartridge as claimed in claim 4, wherein the first engaged part includes an opposing surface configured to oppose the first engaging part in a direction intersecting the axial direction, the opposing surface including:

a first contact surface configured to be contacted by the first engaging part while the drive force is transmitted from the drive-force transmission member to the receiving part; and a second contact surface configured to be contacted by the first engaging part when the drive force transmission from the drive-force transmission member to the receiving part is cancelled, wherein the first engaging part protrudes in a direction intersecting the axial direction is resiliently deformable toward the first rotational axis, the first engaging part including a contact end configured to contact the first engaged part, and wherein the first contact surface is sloped to approach the first rotational axis toward downstream in the first direction, and the second contact surface is sloped to extend away from the first rotational axis toward downstream in the first direction.

7. The cartridge as claimed in claim 4, wherein the detected member further includes a second engaging part, the detected member being configured to be placed at a fourth position before the receiving part receives the drive force from the drive-force transmission member, the receiving part being separated from the drive-force transmission member in the fourth position, and wherein the casing includes a second engaged part engageable with the second engaging part of the detected member at the fourth position, the second engaged part engaging the second engaging part restricting the detected member from rotating in the first direction.

8. The cartridge as claimed in claim 7, wherein the first engaging part also functions as the second engaging part.

9. An image forming device comprising:

a main body provided with a first sensor and a second sensor;

a photosensitive-drum cartridge provided with a photosensitive member for carrying an electrostatic latent image thereon, the photosensitive-drum cartridge being detachable from and attachable to the main body, the second sensor being configured to detect whether the photosensitive-drum cartridge is attached to the main body; and a cartridge configured to accommodate developer therein, the cartridge being mountable on and removable from the photosensitive-drum cartridge, the cartridge comprising:

a detected member configured to rotate in a first direction about a first rotational axis extending in an axial direction, the detected member being configured to be detected by the first sensor, the detected member including a receiving part and a first detected part; and a drive-force transmission member configured to transmit a drive force to the detected member upon receipt of the drive force from the main body, the drive-force transmission member having a peripheral surface formed with gear teeth, the receiving part of the detected member being configured to engage the gear teeth of the drive-force transmission member to receive the drive force therefrom, a portion of the first detected part and a portion of the receiving part being arranged at the same position as each other in the axial direction, the detected member being configured to rotate from a first position to a second position, the first detected part at the first position being capable of receiving the drive force from the drive-force transmission member, the first detected part at the second position being incapable of receiving the drive force from the drive-force transmission member, the first detected part at the second position being contacted by the first sensor, the main body being configured to input the drive force to the cartridge after the second sensor detects whether the photosensitive-drum cartridge is attached to the main body.

* * * * *